US009635481B2

(12) United States Patent
Matsumoto et al.

(10) Patent No.: US 9,635,481 B2
(45) Date of Patent: Apr. 25, 2017

(54) FAILURE DETECTION SYSTEM AND FAILURE DETECTION METHOD

(71) Applicant: PANASONIC INTELLECTUAL PROPERTY MANAGEMENT CO., LTD., Osaka (JP)

(72) Inventors: Hiroyuki Matsumoto, Fukuoka (JP); Shuichi Watanabe, Fukuoka (JP); Toshimichi Tokuda, Fukuoka (JP); Hisashi Tsuji, Fukuoka (JP); Akitoshi Izumi, Fukuoka (JP); Shintaro Yoshikuni, Fukuoka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 16 days.

(21) Appl. No.: 14/809,354

(22) Filed: Jul. 27, 2015

(65) Prior Publication Data

US 2016/0037277 A1 Feb. 4, 2016

(30) Foreign Application Priority Data

Jul. 30, 2014 (JP) ..... 2014-154991

(51) Int. Cl.
*H04R 29/00* (2006.01)

(52) U.S. Cl.
CPC ..... *H04R 29/004* (2013.01)

(58) Field of Classification Search
CPC ..... H04R 29/004
See application file for complete search history.

(56) References Cited

U.S. PATENT DOCUMENTS 6,036,351 A * 3/2000 Wagstaff ..... G01S 3/801 367/901
7,027,607 B2 * 4/2006 Pedersen ..... H04R 25/407 381/313
7,894,769 B2 * 2/2011 Ganley ..... H04R 3/00 381/122

(Continued)

OTHER PUBLICATIONS

Taiga et al., "Acoustic system and digital principle", Corona Publishing Co., Ltd., Mar. 25, 1995, Section 7.1.3 with English language translation, pp. 186-191.

*Primary Examiner* — Brenda Bernardi
(74) *Attorney, Agent, or Firm* — Greenblum & Bernstein, P.L.C.

(57) ABSTRACT

A failure detection system includes an omnidirectional microphone array device having a plurality of microphone elements and a directivity control device that calculates a delay time of a voice propagated from a sound source to each microphone element and forms a directivity of the voice using the delay time and the voice collected by the omnidirectional microphone array device, and detects a failure of the microphone element. A smoothing unit calculates an average power of one microphone element. An average calculator calculates a total average power of a plurality of usable microphone elements included in the omnidirectional microphone array device. A comparison unit compares whether or not a difference between the average power and the total average power exceeds a range of ±6 dB, and determines whether the microphone element is in failure based on the comparison result.

15 Claims, 20 Drawing Sheets

(56) References Cited

U.S. PATENT DOCUMENTS

| | | | | |
|---|---|---|---|---|
| 8,379,876 | B2 * | 2/2013 | Zhang | H04R 29/005 381/58 |
| 2003/0097257 | A1 * | 5/2003 | Amada | G10L 21/0208 704/208 |
| 2007/0286441 | A1 * | 12/2007 | Harsch | H04R 25/30 381/315 |
| 2009/0304194 | A1 * | 12/2009 | Eggleston | H04R 29/001 381/59 |
| 2011/0165888 | A1 * | 7/2011 | Shuman | G06F 17/30041 455/456.1 |
| 2012/0045068 | A1 * | 2/2012 | Kim | H04R 29/005 381/58 |
| 2014/0350935 | A1 * | 11/2014 | Schuster | G10L 15/08 704/251 |
| 2015/0146883 | A1 * | 5/2015 | Palitsky | H04R 3/005 381/92 |

* cited by examiner

FAILURE DETECTION SYSTEM AND FAILURE DETECTION METHOD

BACKGROUND

1. Technical Field

The present disclosure relates to a failure detection system and failure detection method configured to detect a failure in a sound collection element.

2. Description of the Related Art

When collecting a sound of interest such as a voice, a sound collection technology with a high SN ratio is strongly desired so as not to collect an unnecessary sound such as a noise, an interference sound, or the like. In order to achieve such a technology, it is considered that signal processing using a sound collection device (microphone array device) configured of a plurality microphone elements is effective.

As an example of the signal processing using the microphone array device, there is a method (delay-sum method) in which the directivity of a voice is formed in a predetermined direction by adding a different delay time for each microphone element to the audio signal collected by each microphone element, and then summing the audio signals. In this delay-sum method, it is necessary to make the beam width of the directivity be narrow in order to obtain a directivity in the low frequency while it is easy to control the directivity in the signal processing device that performs the signal processing. Therefore, the number of arrayed microphone elements increases, which results in the increase of the size of a microphone array device.

In addition, other than the delay-sum method, there is a method (delay difference method) in which the directivity of a voice is formed in a predetermined direction by subtracting audio signals after adding a delay time to the audio signal and then forming a blind spot (sensitivity is low) in the noise direction. The microphone array device using such a delay difference method automatically forms the directivity according to the surrounding noise environment, and thus, it is called an adaptive microphone array device.

A principle of forming the directivity in the adaptive microphone array device is as follows (for example, refer to following literature: Acoustic system and digital principle, P190, by Taiga, Yamazaki, and Kaneda, Corona Publishing Co., Ltd. Mar. 25, 1995. (Griffith-Jim type adaptive microphone array device). The adaptive microphone array device geometrically calculates a time difference of a collection time in which the audio signal in a target direction is collected in each microphone using an arrival direction of an objective audio signal and an array position of each microphone. The adaptive microphone array device adds a delay amount which corresponds to the time difference between the audio signal collected by each microphone. In this way, phases of the audio signals are synchronized in a target direction. In addition, the adaptive microphone array device erases the audio signal in the target direction by getting a difference between the phase-synchronized audio signal and the adjacent audio signal, and obtains signals (noise signals) that include only multiple noises of adjacent numbers. The adaptive microphone array device can obtain the audio signal in which the surrounding noises are suppressed and the directivity in the target direction is formed by causing each noise signal to pass through an adaptive filter, and then, subtracting the output of the adaptive filter from the delay output of a first microphone.

In the adaptive microphone array device in which the delay difference method is used, in a case where characteristics deteriorate or a failure occurs in any of the microphone elements, it influences the difference result of the audio signal. Then, the audio signal in which the surrounding noises are suppressed in the target direction cannot be obtained, and thus, the accuracy of forming the directivity deteriorates.

For this reason, in the adaptive microphone array device in which the delay difference method is used, it is necessary to check whether or not the characteristics of all the microphone elements are uniform by monitoring the characteristics of the microphone element in use or a circuit for amplifying the audio signal collected by the microphone element.

However, when it is desired to form directivity in an arbitrary direction using a microphone array device, in the adaptive microphone array device in which the delay difference method is used, since it is assumed that the characteristics of all the microphone elements are uniform at the time point before actual using, it is not considered that the characteristics deteriorate or that a failure may occur in the microphone element at the time of actual using. Therefore, for example, at the time of actual use in a case where characteristics deteriorate or there is failure in the microphone element, it can be considered that the accuracy of forming the directivity of a voice in a specific direction from the microphone array device deteriorates.

SUMMARY

An object of the present disclosure is to provide a failure detection system and a failure detection method in which, even during actual using, characteristics of each microphone element included in a microphone array device are monitored and even when the failure occurs in the microphone element, a microphone element in which a failure occurs is specified, and deterioration of the accuracy of forming a directivity of a voice in the predetermined direction is suppressed.

According to the present disclosure, there is provided a failure detection system including: a sound collector configured to include a plurality of sound collection elements; a first calculator configured to calculate an average power of a voice propagated from a sound source to each of the plurality of sound collection elements for each sound collection element; a second calculator configured to calculate a total average power of a voice propagated to a plurality of usable sound collection elements included in the sound collector; and a failure determiner configured to determine whether or not there is an unusable sound collection element in failure based on a comparison result indicating whether or not a difference between the average power and the total average power for each sound collection element exceeds a predetermined range.

According to the present disclosure, there is provided a failure detection method in a failure detection system that includes a sound collector having a plurality of sound collection elements; the method including: a step of calculating an average power of a voice propagated from a sound source to each of the plurality of sound collection elements for each sound collection element; a step of calculating a total average power of the voice propagated to a plurality of usable sound collection elements included in the sound collector; and a step of determining whether or not there is an unusable sound collection element due to failure based on a comparison result indicating whether or not a difference between the average power and the total average power for each sound collection element exceeds a predetermined range.

According to the present disclosure, even during actual using, characteristics of each microphone element included in a microphone array device are monitored and even when the failure occurs in the microphone element, a microphone element in which a failure occurs is specified, and the deterioration of the accuracy of forming a directivity of a voice in the predetermined direction is suppressed.

DETAILED DESCRIPTION OF THE PREFERRED EMBODIMENTS

Hereinafter, embodiments of a failure detection system and a failure detection method in the present disclosure will be described with reference to the drawings. The failure detection system in each embodiment is applied to a monitoring system (including a manned monitoring system and an unmanned monitoring system) installed in, for example, a factory, a public facility (for example, a library or an event venue) or stores (for example, a retail store or a bank).

First Embodiment

Figure 1:
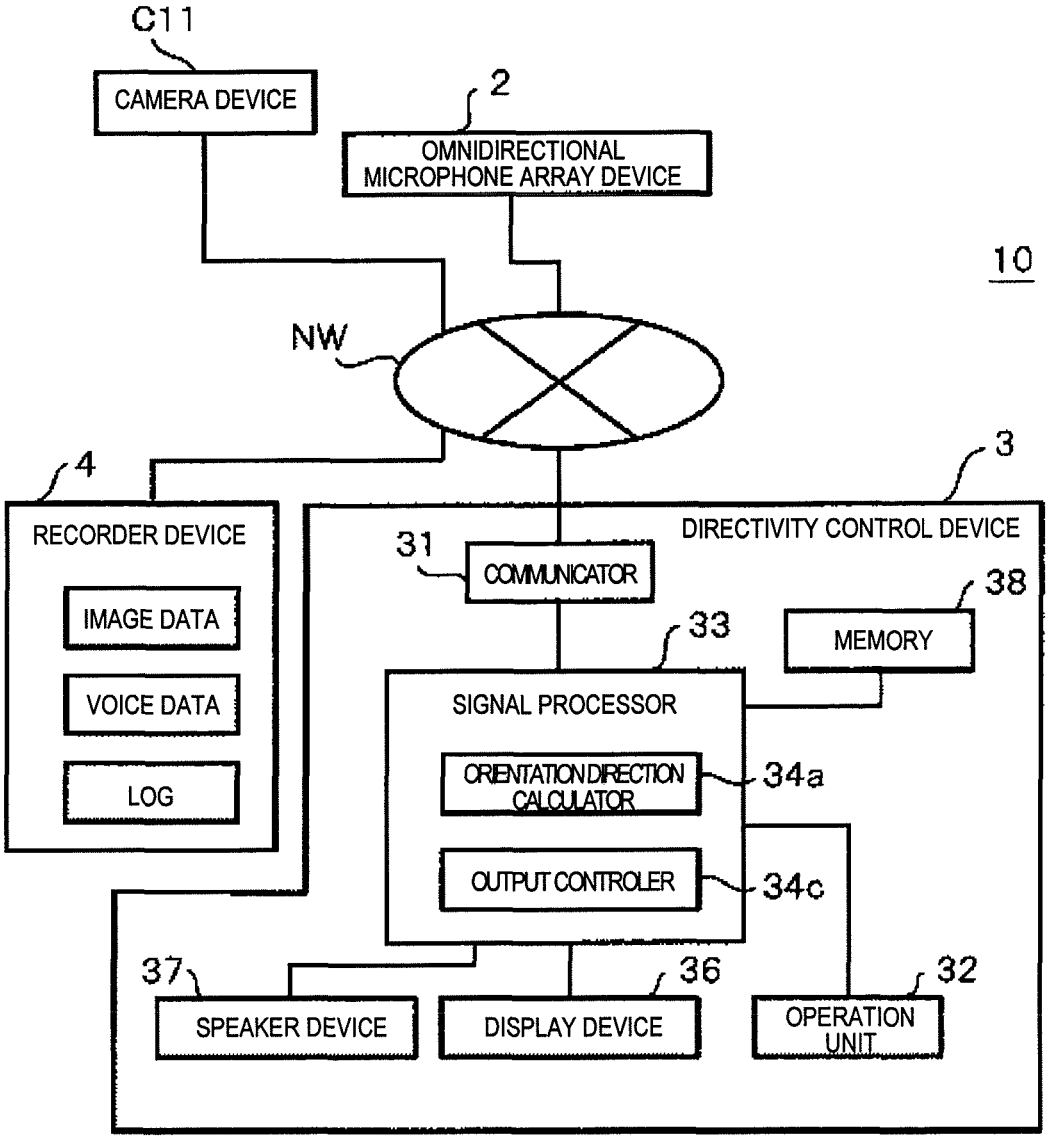
FIG. 1 is the block diagram illustrating a system configuration of a failure detection system in a first embodiment.

FIG. 1 is a block diagram illustrating a system configuration of failure detection system 10 in the first embodiment. Failure detection system 10 illustrated in FIG. 1 is configured to include omnidirectional microphone array device 2, camera device C11, directivity control device 3, and recorder device 4. Omnidirectional microphone array device 2 collects a voice in the sound collection region in which failure detection system 10 is installed, that is, for example, collects a voice generated from a person as an example of a sound source existing in the sound collection region.

A housing of omnidirectional microphone array device 2 is described as having a disk shape as an example in the present embodiment. However, the shape is not limited to the disk shape, and for example, the shape may be a donut shape or a ring shape (refer to FIG. 2A to FIG. 2E).

Figure 2A:
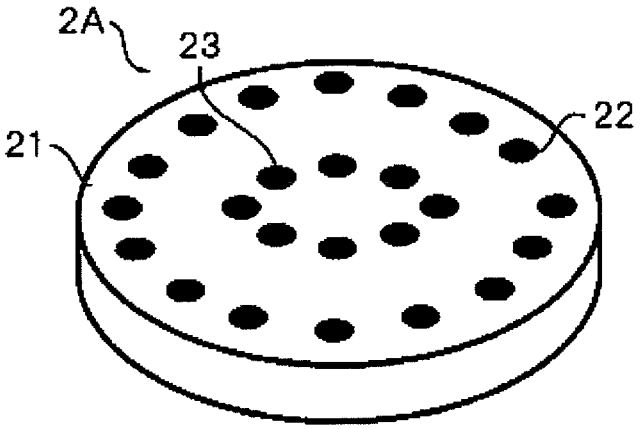
FIG. 2A is an external view of an omnidirectional microphone array device.

In omnidirectional microphone array device 2, for example, a plurality of microphone units 22 and 23 is concentrically arrayed along the circumferential direction of disk-shaped housing 21 (refer to FIG. 2A). In microphone units 22 and 23, for example, high-quality small-sized electric condenser microphones (ECM) are used. The use of ECM is the same in each of the subsequent embodiments.

In failure detection system 10 illustrated in FIG. 1, omnidirectional microphone array device 2, directivity control device 3, and recorder device 4 as an example of voice recorder are connected to each other by network NW. Network NW may be a wired network (for example, intranet or internet), or may be a wireless network (for example, local area network (LAN)). The type of network NW is the same in each of the subsequent embodiments.

Camera device C11 as an example of an imaging unit is, for example, is installed in a state being fixed on a ceiling surface of an event venue. Camera device C11 transmits image data (that is, the omnidirectional image data) indicating an omnidirectional image in the sound collection region or plane image data generated by applying predetermined distortion correction processing on the omnidirectional image data and performing panorama conversion, to directivity control device 3 or recorder device 4 via network NW. Directivity control device 3 performs the zooming-in on the image of the designated position in signal processor 33, and displays the image on display device 36 according to an instruction from operation unit 32.

When an arbitrary position in the image displayed on display device 36 is designated by the user, camera device C11 receives coordinate data of the designated position on the image from directivity control device 3, and calculates a distance and a direction (including a horizontal angle and a vertical angle, hereinafter, the same) to the voice position in actual space corresponding to the designated position (hereinafter, simply referred to as "voice position") from camera device C11, and transmits the result to directivity control device 3. The calculation processing of the distance and direction in camera device C11 is a known technology, and the description thereof will be omitted.

Omnidirectional microphone array device 2 as an example of a sound collector is connected to network NW and is configured to include at least microphone elements 221, 222, . . . , 22*n* (refer to FIG. 3) as an example of sound collection elements arrayed in equal intervals and each unit that performs a predetermined signal processing on the voice data of the voice collected by each microphone element. A detail configuration of omnidirectional microphone array device 2 will be described below with reference to, for example, FIG. 4.

Omnidirectional microphone array device 2 transmits a voice data packet (an example of packet PKT (refer to FIG. 15B)) that includes voice data of the voice collected by each of microphone units 22 and 23 (refer to FIG. 2A) to directivity control device 3 or recorder device 4 via network NW.

When forming the directivity in the orientation direction (refer to the description below) corresponding to the position designated from operation unit 32 (designated position) by the operation of the user using the voice data transmitted from omnidirectional microphone array device 2, directivity control device 3 forms the directivity of the voice data in the orientation direction which is a specific direction using sound speed Vs of a sound propagated from a sound source to each microphone element 221, 222, . . . , and 22*n* (refer to FIG. 3) and a delay time (refer to FIG. 3) that is different for each microphone element.

In this way, directivity control device 3 can increase a volume level of the voice collected from the orientation direction in which the directivity is formed so as to be relatively higher than a volume level of a voice collected from another direction. A method for calculating the orientation direction is a known technology and a detailed description thereof will be omitted.

In addition, each microphone units 22 and 23 of omnidirectional microphone array device 2 may be a nondirectional microphone. A bidirectional microphone, a unidirectional microphone, or a combination thereof may also be used.

In addition, as camera device C11, is not only an omnidirectional camera that images omnidirectionally but also a camera having a panning, tilting, and a zooming function, or a fixed camera that can image the position to be monitored may be used. In this case, the camera may be a combination of multiple cameras, not a single camera.

FIG. 2A to FIG. 2E are external views of omnidirectional microphone array devices 2A, 2B, 2C, 2D, and 2E. In omnidirectional microphone array devices 2A, 2B, 2C, 2D, and 2E illustrated in FIG. 2A to FIG. 2E, the external views and the arrays of the plurality of microphone units are different from each other, but the functions of the omnidirectional microphone array devices are the same. In a case where it is not necessary to specifically distinguish the omnidirectional microphone array devices, the devices will be collectively called omnidirectional microphone array device 2.

Omnidirectional microphone array device 2A illustrated in FIG. 2A has disk-shaped housing 21. In housing 21, a plurality of microphone units 22 and 23 are concentrically arrayed. Specifically, a plurality of microphone units 22 is concentrically arrayed along a large circular shape having the same center as housing 21, and a plurality of microphone units 23 is concentrically arrayed along a small circular shape having the same center as housing 21. Intervals between each of the plurality of microphone units 22 are wide, and the diameter of each microphone unit 22 is large. Thus, the characteristics of the plurality of microphone units 22 are suitable for a low frequency range. On the other hand, intervals between each of the plurality of microphone units 23 are narrow, and the diameter of each microphone unit 23 is small. Thus, the characteristics of the plurality of microphone units 23 are suitable for a high frequency range.

Figure 2B:
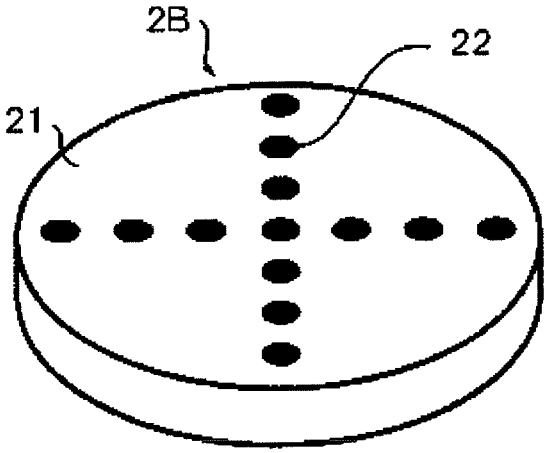
FIG. 2B is an external view of an omnidirectional microphone array device.

Omnidirectional microphone array device 2B illustrated in FIG. 2B includes disk-shaped housing 21. In housing 21, a plurality of microphone units 22 is arrayed in straight lines with uniform intervals, and arrayed such that centers of a plurality of microphone units 22 arrayed in the horizontal direction and a plurality of microphone units 22 arrayed in the vertical direction intersect at the center of housing 21. Since the plurality of microphone units 22 is arrayed in the horizontal and vertical straight lines in omnidirectional microphone array device 2B, it is possible to decrease the calculation amount of the processing of forming the directivity of the audio data. The plurality of microphone units 22 may be arrayed in only one line in the vertical or horizontal direction.

Figure 2C:
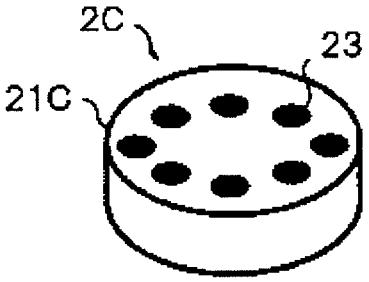
FIG. 2C is an external view of an omnidirectional microphone array device.

Omnidirectional microphone array device 2C illustrated in FIG. 2C includes disk-shaped housing 21C of which the diameter is smaller than that of omnidirectional microphone array device 2A illustrated in FIG. 2A. In housing 21C, a plurality of microphone units 23 is uniformly arrayed along a circumferential direction. Omnidirectional microphone array device 2C in FIG. 2C has characteristics that the intervals between each microphone unit 23 are narrow, and thus, it is suitable for a high frequency range.

Figure 2D:
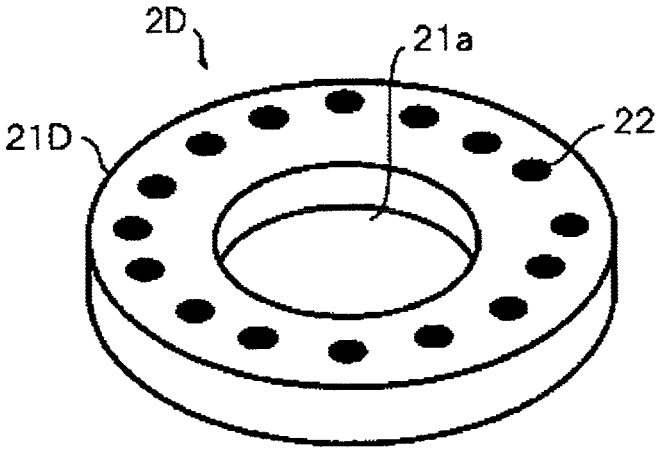
FIG. 2D is an external view of an omnidirectional microphone array device.

Omnidirectional microphone array device 2D illustrated in FIG. 2D has a donut-shaped or a ring-shaped housing 21D in which a predetermined-sized opening portion 21*a* is formed at the center of the housing. In housing 21D, a plurality of microphone units 22 is concentrically arrayed at uniform intervals in the circumferential direction of housing 21D.

Figure 2E:
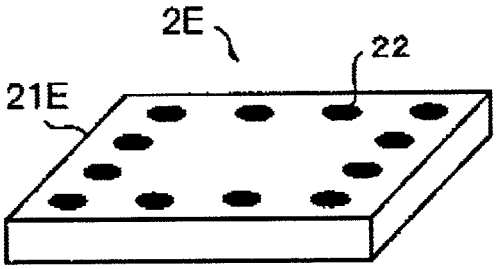
FIG. 2E is an external view of an omnidirectional microphone array device.

Omnidirectional microphone array device 2E illustrated in FIG. 2E includes rectangular shaped housing 21E. In housing 21E, a plurality of microphone units 22 is arrayed at uniform intervals in the outer circumferential direction of housing 21E. In omnidirectional microphone array device 2E illustrated in FIG. 2E, since housing 21E is formed in a rectangular shape, it is possible to simply install omnidirectional microphone array device 2E even in a position such as a corner.

Directivity control device 3 is connected to network NW, and may be a stationary type personal computer (PC) installed in, for example, a monitoring system control room (not illustrated), or may be a data communication terminal such as a user-portable mobile phone, a tablet terminal, or a smart phone.

Directivity control device 3 is configured to include at least communicator 31, operation unit 32, signal processor 33, display device 36, speaker device 37, and memory 38. In FIG. 1, signal processor 33 is configured to include at least orientation direction calculator 34*a* and output controller 34*c*, and an example of a detailed configuration of signal processor 33 will be described below with reference to FIG. 5.

Communicator 31 receives packet PKT (refer to FIG. 15B) transmitted from omnidirectional microphone array device 2 and recorder device 4 via network NW and outputs packet PKT to signal processor 33.

Operation unit 32 is a user interface (UI) for notifying signal processor 33 of the content of the user's operation, and is a pointing device such as a mouse or a keyboard. In addition, operation unit 32 may be configured using a touch panel or a touch pad which is disposed, for example, on the screen of display device 36 and is capable of being operated by a user's finger or a stylus pen.

Operation unit 32 acquires coordinates data indicating the position (that is, a position where the volume level of the voice output from speaker device 37 is desired to be increased or decreased) of the image (that is, an image captured by camera device C11, hereinafter, the same) displayed on display device 36 and designated by the user's operation, and outputs the data to signal processor 33.

Signal processor 33 is configured using, for example, a central processor (CPU), a micro processor (MPU), or a digital signal processor (DSP), and performs control processing for the overall administration of each unit in directivity control device 3, input processing of data between each of other units, data calculation (computation) processing, and data storage processing.

Orientation direction calculator 34*a* calculates coordinates that indicate the orientation direction toward the voice position corresponding the designated position from omnidirectional microphone array device 2 according to the user's position designation operation on the image displayed on display device 36. The specific calculation method by orientation direction calculator 34*a* described above is a known technology, and the details thereof will not be repeated.

Orientation direction calculator 34*a* calculates the orientation direction coordinates toward the voice position from the installed position of omnidirectional microphone array device 2 using the data of the distance and the direction from the installed position of camera device C11 to the voice position. For example, in a case where the housing of omnidirectional microphone array device 2 and camera device C11 are integrally mounted so as to surround the housing camera device C11, the direction (the horizontal angle and the vertical angle) from camera device C11 to the voice position can be used as the orientation direction coordinates from omnidirectional microphone array device 2 to the voice position.

In a case where the housing of camera device C11 and the housing of omnidirectional microphone array device 2 are separately mounted, orientation direction calculator 34*a* calculates the orientation direction from omnidirectional microphone array device 2 to the voice position using calibration parameter data calculated in advance and data of the direction (horizontal angle and the vertical angle) from camera device C11 to the voice position. The calibration is an operation for calculating or acquiring a predetermined calibration parameter necessary for orientation direction calculator 34*a* of directivity control device 3 to calculate the coordinates indicating the orientation direction, and is assumed to be performed by the known technology in advance.

The voice position is a position of an actual monitoring target or a sound collection target in the field corresponding to the designated position of the image displayed on the display device 36 designated by operation unit 32 using the user's finger or the stylus pen.

Output controller 34*c* controls the operation of display device 36 and speaker device 37, and for example, displays the image data transmitted from camera device C11 on display device 36, and outputs the voice data included in packet PKT (for example, a voice data packet) transmitted from omnidirectional microphone array device 2 from speaker device 37 according to, for example, the operation of the user. In addition, output controller 34*c* as an example of a directivity former forms the directivity of the voice data collected by omnidirectional microphone array device 2 from omnidirectional microphone array device 2 to the orientation direction indicated by the coordinates calculated by orientation direction calculator 34*a*. However, the omnidirectional microphone array device 2 may form the directivity.

Display device 36 as an example of a display unit displays the image data transmitted from, for example, camera device C11 on the screen under the control of output controller 34*c* according to, for example, the user's operation.

Speaker device 37 as an example of a voice output unit outputs the voice data included in packet PKT transmitted from omnidirectional microphone array device 2 or the voice data in which the directivity is formed in the orientation direction calculated by orientation direction calculator 34*a*. Display device 36 and speaker device 37 may be configured separate from directivity control device 3.

Memory 38 as an example of a storage unit is configured using, for example, a random access memory (RAM) and functions as a work memory at the time of operation of each unit in directivity control device 3, and furthermore, stores the data necessary for the operation of each unit in directivity control device 3.

Recorder device 4 as an example of a voice recorder stores the voice data included in packet PKT transmitted from omnidirectional microphone array device 2 and the image data transmitted from, for example, camera device C11 in association with each other. Furthermore, an error notification packet transmitted from omnidirectional microphone array device 2 is also stored as a log. Since a plurality of camera devices is included in failure detection system 10 illustrated in FIG. 1, recorder device 4 may store the image data transmitted from each camera device and the voice data included in packet PKT transmitted from omnidirectional microphone array device 2 in association with each other.

In a case of receiving the error notification packet from omnidirectional microphone array device 2 separately from packet PKT of the voice data during the recording (in other words, during the storage of packet PKT of the voice data transmitted from omnidirectional microphone array device 2), or in a case of receiving packet PKT of the voice data in which information on the microphone element in failure, recorder device 4 causes an LED (not illustrated) as an example of an illumination unit provided on the front surface of the housing of recorder device 4 to blink or causes an LCD (not illustrated), as an example of a display unit provided on the front surface of the housing of recorder device 4, to display information. In this way, recorder device 4 can visually notify the user of the fact that there is a microphone element in failure.

In addition, in a case of receiving the error recovery packet from omnidirectional microphone array device 2 separately from packet PKT of the voice data during the recording (in other words, during the storage of packet PKT of the voice data transmitted from omnidirectional microphone array device 2), or in a case of receiving packet PKT of the voice data in which information on the restored (recovered) microphone element is stored, recorder device 4 causes an LED (not illustrated) provided on the front surface of the housing of recorder device 4 to stop blinking or causes an LCD (not illustrated), as an example of a display unit provided on the front surface of the housing of recorder device 4, to stop displaying. In this way, recorder device 4 can visually notify the user of the fact that there is a restored (recovered) microphone element.

Figure 3:
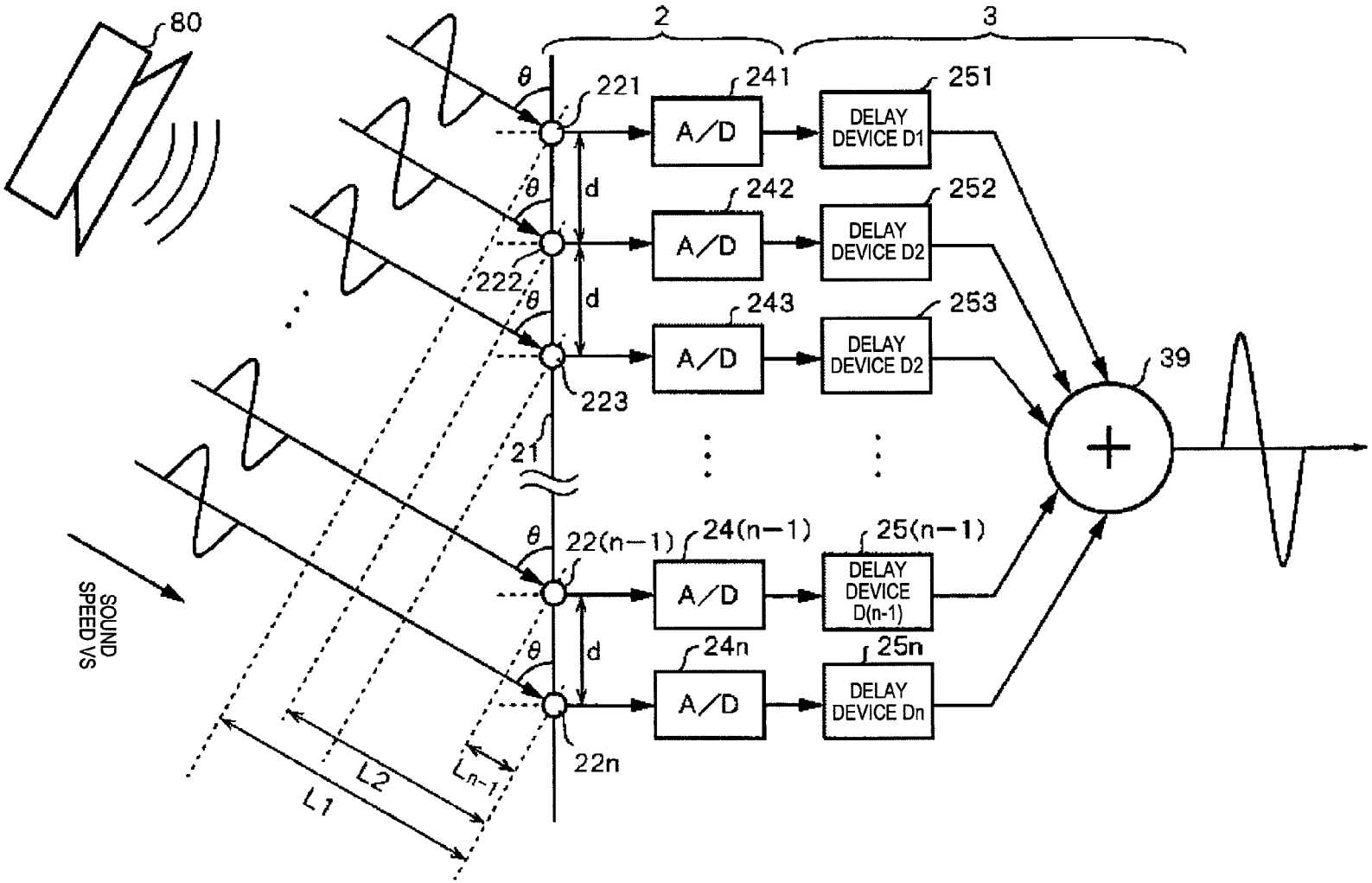
FIG. 3 is an explanatory diagram explaining an example of a principle of forming directivity in a direction θ with respect to a voice collected by the omnidirectional microphone array device.

FIG. 3 is an explanatory diagram explaining an example of a principle of forming directivity in a direction θ with respect to a voice collected by omnidirectional microphone array device 2. In FIG. 3, a principle of directivity forming processing using the delay-sum method is briefly described. However, in the present embodiment, the method is not limited to the case where the directivity forming processing is performed using the delay-sum method illustrated in FIG. 3, and for example, the directivity forming processing may be performed using the delay-difference method illustrated in NPTL 1.

In FIG. 3, a sound wave generated from sound source 80 is incident on each microphone element 221, 222, 223, . . . , 22(*n*−1), and 22*n* embedded in microphone units 22 and 23 of omnidirectional microphone array device 2 with a constant incident angle θ. The incident angle θ illustrated in FIG. 3 may be any of a horizontal angle or a vertical angle from omnidirectional microphone array device 2 toward the voice position.

Sound source 80 is, for example, a subject of a sound wave camera existing in the direction of the sound collection by omnidirectional microphone array device 2, and exists in the direction of predetermined angle θ to the surface of housing 21 of omnidirectional microphone array device 2. In addition, interval d between each microphone element 221, 222, 223, . . . , 22(*n*−1), and 22*n* is assumed to be constant.

The sound wave generated from sound source 80 first arrives at (propagates to) microphone element 221 to be collected, and next, arrives at microphone element 222 to be collected, similarly arrives at subsequent microphone elements one after another to be collected, and finally arrives at microphone element 22*n* to be collected.

The direction toward sound source 80 from the position of each microphone element 221, 222, 223, . . . , 22(*n*−1), and 22*n* of omnidirectional microphone array device 2 is the same direction toward the voice position corresponding to the designated position on the screen of display device 36 designated by the user from each microphone element of omnidirectional microphone array device 2.

Here, arrival time difference τ1, τ2, τ3, . . . , τ (n−1) is generated between the time when the sound wave arrives at each microphone element 221, 222, 223, . . . , 22(*n*−1) and the time when the sound wave finally arrives at microphone element 22*n*. For this reason, in a case where the voice data in which each microphone element 221, 222, 223, . . . , 22(*n*−1), and 22*n* is collected is added as it is, since the addition is performed with the phase deviated as it is, the overall volume level of the sound wave becomes weak.

τ1 is a time difference between the time when the sound wave arrives at microphone element 221 and the time when the sound wave arrives at microphone element 22*n*, τ2 is a time difference between the time when the sound wave arrives at microphone element 222 and the time when the sound wave arrives at microphone element 22*n*, and τ (n−1) is a time difference between the time when the sound wave arrives at microphone element 22(*n*−1) and the time when the sound wave arrives at microphone element 22*n*.

In the directivity forming processing in the present embodiment, an analog voice signal is converted to a digital voice signal by each AD converter 241, 242, 243, . . . , 24(*n*−1), and 24*n* provided corresponding to each microphone element 221, 222, 223, . . . , 22(*n*−1), and 22*n*.

Furthermore, a predetermined delay time is added to the digital voice signal in each delay device 251, 252, 253, . . . , 25(*n*−1), and 25*n* provided corresponding to each microphone element 221, 222, 223, . . . , 22(*n*−1), and 22*n*.

The output of each delay device 251, 252, 253, . . . , 25(*n*−1), and 25*n* is added in output adder 39.

In a case where the directivity forming processing is performed in omnidirectional microphone array device 2, delay devices 251, 252, 253, . . . , 25(*n*−1), and 25*n* are provided in omnidirectional microphone array device 2, and in a case where the directivity forming processing is performed in directivity control device 3, delay devices 251, 252, . . . , 253, 25(*n*−1), and 25*n* are provided in directivity control device 3.

Furthermore, in the directivity forming processing illustrated in FIG. 3, each delay device 251, 252, 253, . . . , 25(*n*−1), and 25*n* gives the delay time corresponding to the arrival time difference in each microphone element 221, 222, 223, . . . , 22(*n*−1), and 22*n* and aligns and synchronizes all the phases of the sound wave, and then, the voice data is added after the delay processing in output adder 39. In this way, omnidirectional microphone array device 2 or directivity control device 3 can form the directivity of the voice collected by each microphone element 221, 222, 223, . . . , 22(*n*−1), and 22*n* in the direction θ.

For example, in FIG. 3, each delay time D1, D2, D3, . . . , D(n−1), and Dn given by each delay device 251, 252, 253, . . . , 25(*n*−1), and 25*n* respectively corresponds to arrival time difference τ1, τ2, τ3, . . . , τ (n−1), and is expressed by Equation (1).

$$D1 = \frac{L1}{Vs} = \frac{\{d \times (n-1) \times \cos\theta\}}{Vs}$$
$$D2 = \frac{L2}{Vs} = \frac{\{d \times (n-2) \times \cos\theta\}}{Vs}$$
$$D3 = \frac{L3}{Vs} = \frac{\{d \times (n-3) \times \cos\theta\}}{Vs}$$
$$, \ldots ,$$
$$Dn-1 = \frac{Ln-1}{Vs} = \frac{\{d \times 1 \times \cos\theta\}}{Vs}$$
$$Dn = 0 \ldots (1)$$

Equation (1)

L1 is the difference in sound wave arrival distance between microphone element 221 and microphone element 22*n*. L2 is the difference in sound wave arrival distance between microphone element 222 and microphone element 22*n*. L3 is the difference in sound wave arrival distance between microphone element 223 and microphone element 22*n*, and similarly, L (n−1) is the difference in sound wave arrival distance between microphone element 22(*n*−1) and microphone element 22*n*. Vs is the sonic speed of the sound wave. This sonic speed Vs may be calculated by omnidirectional microphone array device 2, or may be calculated by directivity control device 3 (refer to the description below). L1, L2, L3, . . . , L(n−1) have known values. In FIG. 3, delay time Dn set in delay device 25*n* is zero.

In the directivity forming processing, delay time Di (i is an integer from one to n, n is an integer equal to greater than two) given to the voice data of the voice collected by each microphone element and is inversely proportional to sonic speed Vs as expressed in Equation (1).

As described above, omnidirectional microphone array device 2 or directivity control device 3 can simply and arbitrarily form the directivity of the voice data of the voice collected by each microphone element 221, 222, 223, . . . , 22(*n*−1), and 22*n* embedded in microphone unit 22 or microphone unit 23 by changing delay time D1, D2, D3, . . . , D(n−1), and Dn given by each delay device 251, 252, 253, . . . , 25(*n*−1), and 25*n*.

Figure 4:
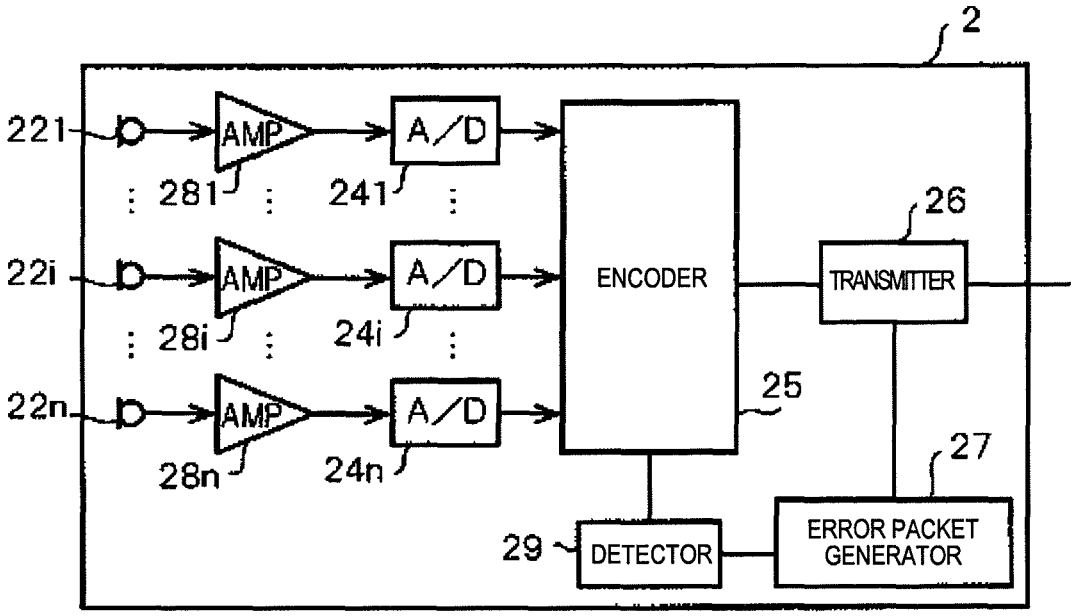
FIG. 4 is a block diagram illustrating an internal configuration of the omnidirectional microphone array device.

FIG. 4 is a block diagram illustrating an internal configuration of omnidirectional microphone array device 2. Omnidirectional microphone array device 2 illustrated in FIG. 4 is configured to include a plurality of (n, for example, n=16) microphone elements 22*i*, n pieces of amplifiers 28*i* that amplifies the output signal from each microphone element 22*i*, n pieces of AD converters 24*i* that converts the analog signal output from each amplifier 28*i* to the digital signal, encoder 25, detector 29, error packet generator 27, and transmitter 26. Here, the suffix i of microphone element 22*i* is the number of each microphone elements 1 to n (total number of microphone elements), and it is similar to amplifier 28*i* and AD converter 24*i*.

Encoder 25 encodes the digital voice signals (voice data) output from n pieces of AD converter 24*i*. Detection unit 29 as an example of a failure determiner performs the failure detection for each microphone element 22*i* using the voice data encoded in encoder 25.

In a case where it is determined by detector 29 that any one of the microphone elements is in failure, error packet generator 27 generates an error notification packet that includes information on the microphone element in failure. In addition, in a case where the microphone element determined to be in failure is restored (recovered) by a work such as repair or inspection (for example, the acoustic characteristics of the microphone element becomes to be desired characteristics), error packet generator 27 generates an error recovery packet that includes information on the recovered microphone element. As described above, an identification number (microphone ID) used for identifying the microphone element is added to the error notification packet and the error recovery packet.

Transmission unit 26 generates packet PKT of the encoded voice data and transmits the packet to directivity control device 3 or recorder device 4 which is in the process of recording. In addition, transmitter 26 transmits the error notification packet and the error recovery packet to directivity control device 3 or recorder device 4 which is in the process of recording. Transmission unit 26 may transmit packet PKT of the voice data to directivity control device 3 or recorder device 4 which is in the process of recording while adding the information about the microphone element in failure or the recovered microphone element.

Figure 5:
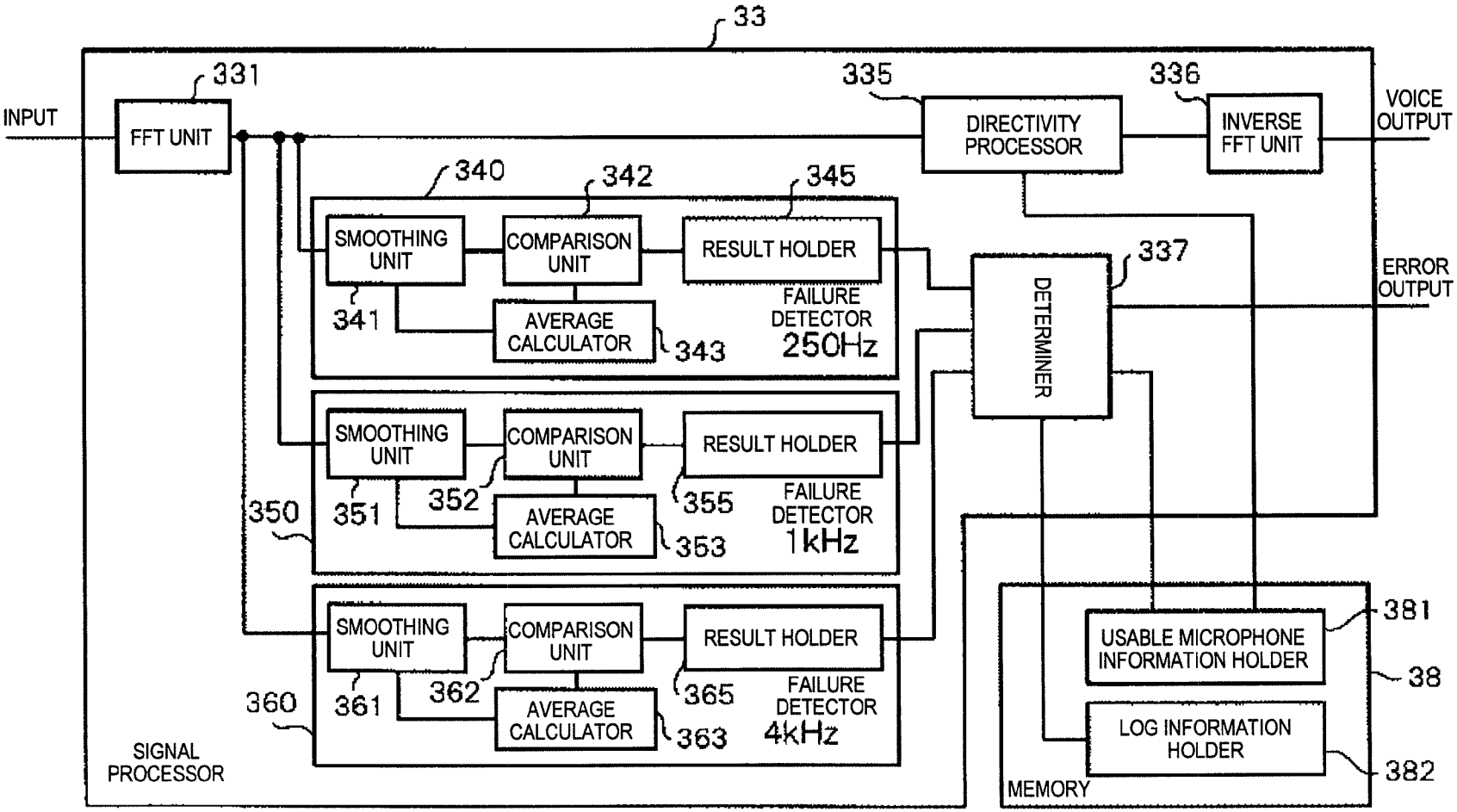
FIG. 5 is a block diagram illustrating an internal configuration of a signal processor and a memory.

FIG. 5 is a block diagram illustrating an internal configuration of signal processor 33 and memory 38. Signal processor 33 illustrated in FIG. 5 is configured to include orientation direction calculator 34*a*, output controller 34*c*, FFT unit 331, for example, three failure detectors 340, 350, and 360, directivity processor 335, inverse FFT unit 336, and determination unit 337. For the simplicity of explanation, orientation direction calculator 34*a* and output controller 34*c* are not illustrated in FIG. 5.

FFT (Fast Fourier Transform) unit 331 performs a Fourier transform on the input time axis signal to convert the time axis signal of the voice data to a frequency axis signal. The output of FFT unit 331 is input to three failure detectors 340, 350, 360, and to directivity processor 335.

Failure detector 340 includes smoothing unit 341, comparison unit 342, average calculation unit 343, and result holder 345. The configurations of failure detectors 340, 350 and 360 are the same, and the description will be made with failure detectors 340 an example. The description of the contents which are the same in the three failure detectors 340, 350 and 360 will be simplified or omitted, and the contents which are different from each other will be described.

A signal having a predetermined range of frequency component with, for example, 250 Hz as a center among the output of FFT unit 331 is input to failure detector 340. In addition, a signal having a predetermined range of frequency component with, for example, 1 kHz as a center among the output of FFT unit 331 is input to failure detector 350. Similarly, a signal having a predetermined range of frequency component with, for example, 4 kHz as a center among the output of FFT unit 331 is input to failure detector 360.

Smoothing unit 341 calculates a sound pressure level (acoustic power) and smoothes the pressure level using a sampling result of one frame (for example, 256 signals) of audio signals output from microphone element 22*i*, and then, obtains an average acoustic power (hereafter, simply referred to as "average power") of audio signals for each microphone element 22*i*.

Average calculation unit 343 smoothes the average power of all the usable (in other words, not in failure) microphone elements among the entire microphone elements of omnidirectional microphone array device 2, and then, calculates total average acoustic power (hereafter, simply referred to as "total average power") of audio signals.

Comparison unit 342 determines whether or not the difference between the average power of the microphone element which is subject to inspection for failure detection and the total average power of all the usable microphone elements is within a predetermined range (for example, a range of ±6 dB). Result holder 345 stores the output (comparison result) from comparison unit 342.

As an example of processing of output controller 34*c*, directivity processor 335 forms the directivity of the voice using the voice data collected by microphone element 22*i* and the coordinates indicating the orientation direction toward the voice position corresponding to the designated position of the image displayed on the display device 36 designated by operation unit 32. In the above description, directivity processor 335 is described to be included as an example of output controller 34*c*. However, directivity processor 335 may be configured as a processor in signal processor 33 other than output controller 34*c*.

As an example of processing of output controller 34*c*, inverse FFT (Inverse Fast Fourier Transform) unit 336 performs an inverse Fourier transform on the output (that is, the frequency axis signal of the voice on which the directivity of the voice is formed in the orientation direction) of directivity processor 335 to convert the frequency axis signal of the voice data to the time axis signal, and then, outputs the result to speaker device 37. Inverse FFT unit 336 is also described as being included as an example of output controller 34*c* as similar to the directivity processor 335. However, inverse FFT unit 336 may be configured as a processor in signal processor 33 other than output controller 34*c*.

Determination unit 337 as an example of failure determiner determines whether or not any of microphone element 22*i* is in failure based on the comparison result held in each of result holders 345, 355 and 365 of each of three failure detectors 340, 350 and 360.

Memory 38 is configured using, for example, a random access memory (RAM), and is configured to include usable microphone information holder 381 and log information holder 382. Usable microphone information holder 381 stores information on the microphone element which is not in failure (in other words, usable) among the entirety of the microphone elements of omnidirectional microphone array device 2. Usable microphone information holder 381 may store the information on the unusable microphone elements together with the information on the usable microphone elements.

Log information holder 382 stores the determination result in which it is determined by determiner 337 that there is a microphone element in failure.

Figure 6A:
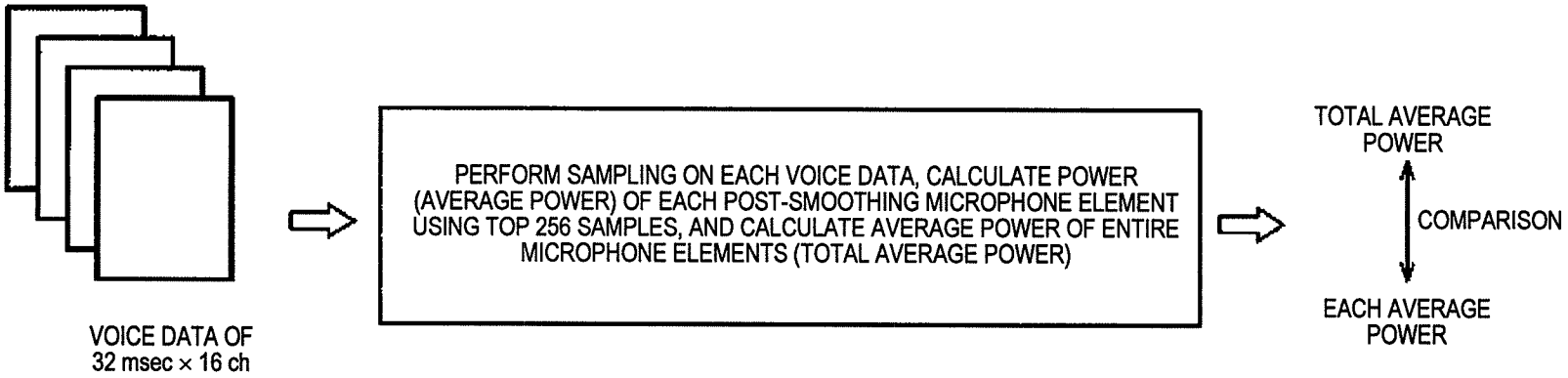
FIG. 6A is a diagram explaining an error detection processing method performed by the omnidirectional microphone array device.
Figure 6B:
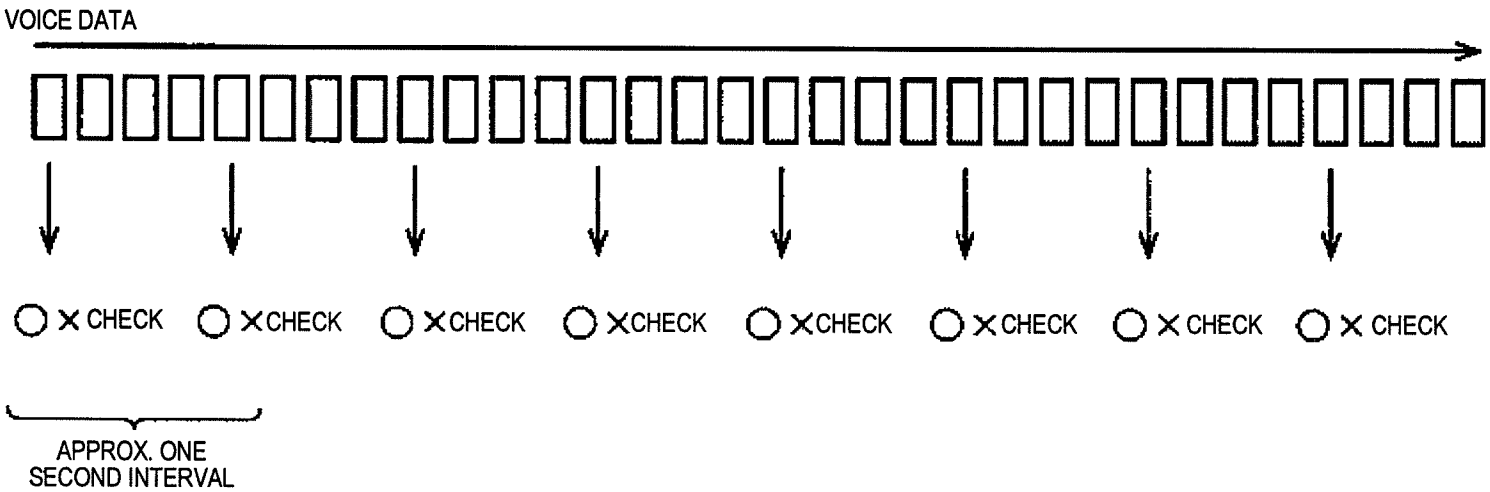
FIG. 6B is a diagram explaining an error detection processing method performed by the omnidirectional microphone array device.

Next, an operation of failure detection system 10 in the present embodiment will be described with reference to the drawings. In the present embodiment, omnidirectional microphone array device 2 determines whether or not there is a failure in microphone element 22*i*, and further, directivity control device 3 also determines whether or not there is a failure in microphone element 22*i*. First, an operation of determining whether or not there is a failure of microphone element 22*i* in omnidirectional microphone array device 2 will be described with reference to FIG. 6A and FIG. 6B. FIG. 6A and FIG. 6B are diagrams explaining an error detection processing method performed by omnidirectional microphone array device 2.

As illustrated in FIG. 6A, at the time of obtaining the average power and the total average power used in detecting the failure of microphone element 22*i*, detector 29 acquires 512 pieces of sampling data by sampling the 16 channels (16 microphone elements) of voice data of 32 msec with the sampling frequency of 16 kHz. Detection unit 29 calculates the power (average power) which is a post-smoothing sound pressure level with respect to microphone element 22*i* subject to the inspection for failure detection using the top 256 pieces of sampling data among the 512 pieces of sampling data.

Furthermore, detector 29 calculates the average value of the post-smoothing sound pressure level (power) with respect to all the microphone element which is not in failure (in other words, usable) among the omnidirectional microphone array device 2 using the top 256 pieces of sampling data among the 512 sampling data, and then, calculates the total average power of all the microphone elements (for example, 16 microphone elements). As described above, since detector 29 performs the sampling on the voice data at a predetermined interval (period=1/16 kHz), and calculates the average power using many of the sampling data, it is possible to increase the accuracy of calculating the average power.

As illustrated in FIG. 6B, at the time of performing the detection of the failure of microphone element 22*i*, detector 29 periodically performs the sampling of the voice data of 16 microphone elements in an approximately one second interval, and then, calculates the post-smoothing average power using the sampling data. In a case where the difference between the average power and the total average power of the microphone elements is within a predetermined range (range of ±6 dB), detector 29 determines that the state is normal (indicated as "O" illustrated in FIG. 6B), and in a case where the difference exceeds the predetermined range, detector 29 determines that there is an error (indicated as "X" illustrated in FIG. 6B). In addition, in a case where, for example, as a comparison result, it is determined that an error occurs five times consecutively, detector 29 determines that the microphone element is in failure. In addition, in a case where it is determined to be normal even one time out of the five times, detector 29 clears the number of errors to zero until the time of determination is normal, and then, determines that the microphone element is normal. In addition, even after the microphone element is once determined to be in failure, in a case where, for example, as a comparison result, it is determined that the state is normal five consecutive times, detector 29 determines that the microphone element is restored (recovered), and thus, normal.

Figure 7:
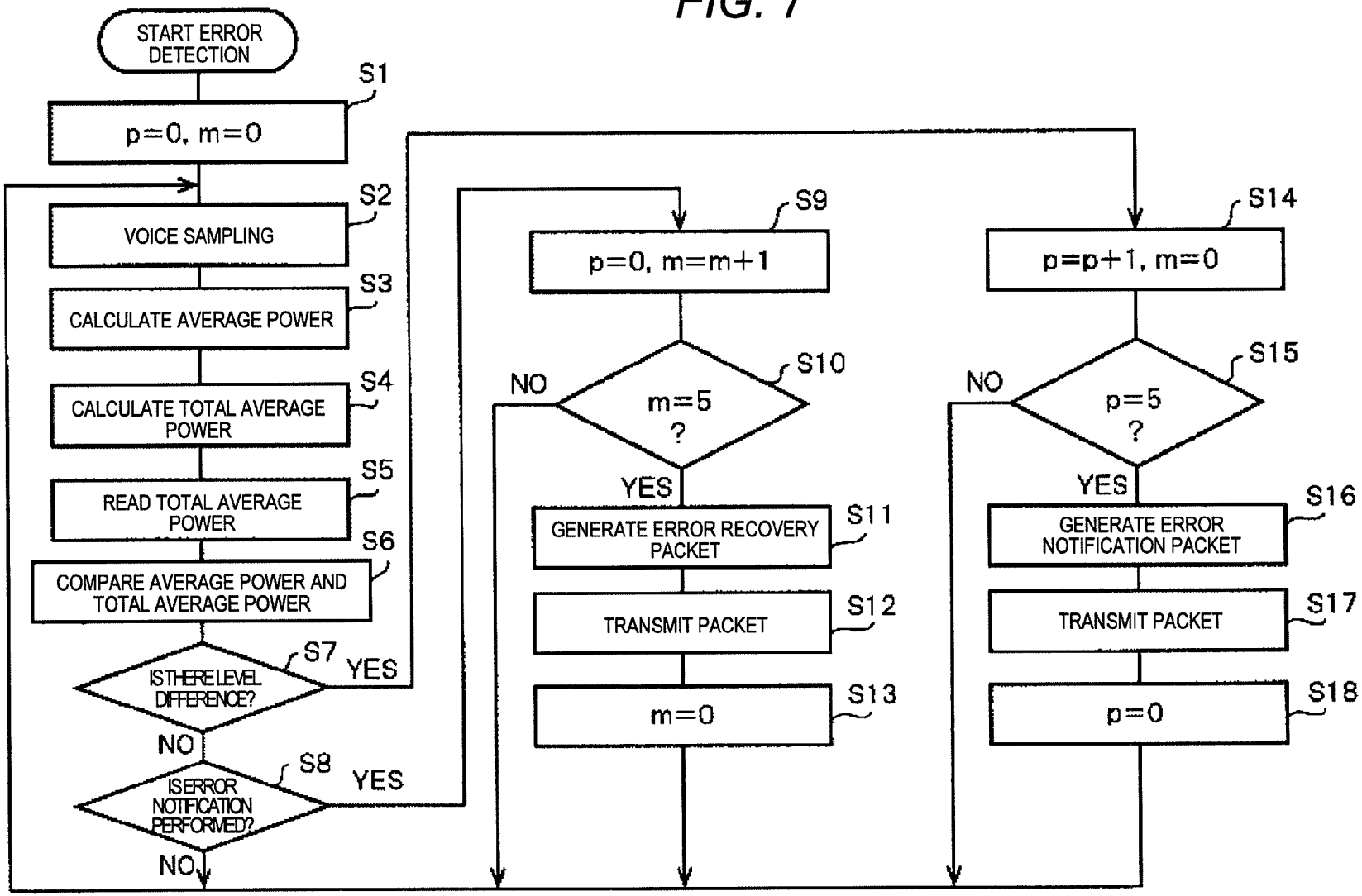
FIG. 7 is a flowchart explaining an operation procedure of the error detection processing in the omnidirectional microphone array device.

FIG. 7 is a flowchart explaining an operation procedure of error detection processing in omnidirectional microphone array device 2. In FIG. 7, a variable p represents the number of consecutive NGs (the number of consecutive errors), and variable m represents the number of consecutive OKs (the number of consecutive normals). In addition, the error detection processing illustrated in FIG. 7 is performed for each microphone element, for example, in a case where the number of total microphone elements is 16, when the processing is performed 16 times, the error detection processing of all the microphone elements is finished.

First, detector 29 sets the value of consecutive NGs p and the value of consecutive OKs m to zero (S1). Detection unit 29 performs the sampling on the voice data encoded by encoder 25 (S2). In this sampling, for example, the top 256 sampling data of the voice data of 32 msec is extracted within a one second interval.

Detection unit 29 calculates the average power from the 256 pieces of sampling data (S3). Furthermore, detector 29 calculates the average power of all the channels (that is, all the microphone elements) (total average power) (S4). For example, detector 29 may calculate the total average power by storing the total average power after calculating the average power of each microphone element, and then, averaging the average power of all the latest microphone elements, or may calculate the total average power by adding the 256 pieces of sampling data of all the microphone elements, and then, averaging the added sampling data. Detection unit 29 stores the calculated total average power in the memory (not illustrated).

Detection unit 29 reads the total average power stored in the memory (S5), and compares the average power calculated in S3 and the total average power (S6).

Detection unit 29 determines whether or not the difference between the average power and the total average power is within the predetermined level difference, that is, whether or not it exceeds the predetermined range (as an example here, whether or not exceeds ±6 dB) (S7). In a case where there is no level difference, that is, the level difference does not exceed the predetermined range, in other words, in a case where the level difference is within ±6 dB and it is determined to be normal (NO in S7), detector 29 determines whether or not the error notification is performed (S8). In a case where the error notification is not performed (NO in S8), the processing of detector 29 returns to step S2.

On the other hand, in a case where the error notification is performed in step S8 (YES in step S8), detector 29 increases the value of the number of consecutive OKs m by an increment of one (S9). Detection unit 29 determines whether or not the value of the number of consecutive OKs m becomes five (S10). In a case where the value of m is less than five (NO in S10), the processing of detector 29 return to step S2. On the other hand, in a case where the value of m is five (YES in S10), error packet generator 27 generates the error recovery packet (S11). Replacing the failed microphone element by a predetermined operation or recovering the failed microphone element to a normal microphone element by repairing is an example of the result of processing in S11.

Transmission unit 26 transmits the error recovery packet generated by error packet generator 27 to directivity control device 3 or recorder device 4 which is in the process of recording (S12). Detection unit 29 clears the value of the number of consecutive OKs m to zero (S13). After step S13, the processing of detector 29 returns to step S2.

On the other hand, in a case where the level difference between the average power and the total average power exceeds the predetermined range in step S7 (YES in S7), detector 29 increases the value of the number of consecutive NGs p by increment of one (S14). Detection unit 29 determines whether or not the value of the number of consecutive NGs becomes five (S15). In a case where the value of p is not five (NO in S15), the processing of detector 29 returns step S2. On the other hand, in a case where the value of p is five (YES in S15), error packet generator 27 generates the error notification packet (S16). An alarm notification is included in the error notification packet.

Transmission unit 26 transmits the error notification packet generated by error packet generator 27 to directivity control device 3 or recorder device 4 which is in the process of recording (S17). Detection unit 29 clears the value of the number of consecutive NGs p to zero (S18). After step S18, the processing of detector 29 returns step S2.

As described above, omnidirectional microphone array device 2 calculates the average power from the top 256 pieces of sampling data of the voice data of 32 msec of each channel (one microphone element) in an interval of approximately one second, compares the average power with the average value of the entire channel (here, 16 microphone elements), and in a case where the difference exceeds the range of ±6 dB five consecutive times, determines that the microphone element used in comparison is in failure, and then, transmits the error notification packet. Omnidirectional microphone array device 2 determines the failure of the microphone element in a case of exceeding the range five consecutive times. Therefore, the errors temporarily occurring at the time of collecting the sound can be excluded, and thus, it is possible to improve the determination accuracy of determining the failure of the sound collection element. In addition, since the error notification packet is transmitted, directivity control device 3 can simply specify the sound collection element in failure by the failure data packet. In addition, recorder device 4 can store the log of the failure or the recovery of the microphone element by the error notification packet or the error recovery packet, and can notify the user of the failure or the restore (recovery) of the microphone element by blinking the LEDs (not illustrated) provided on recorder device 4 or by displaying the information on the LCD (not illustrated) provided on recorder device 4.

In addition, even for the microphone element determined to be in the error state, in a case where the average power of the such a microphone element is within ±6 dB in consecutively five times, omnidirectional microphone array device 2 determines that the microphone element is recovered by replacement or repair, and transmits the error recovery packet. In this way, omnidirectional microphone array device 2 can simply determine the recovery of the microphone element.

Figure 8:
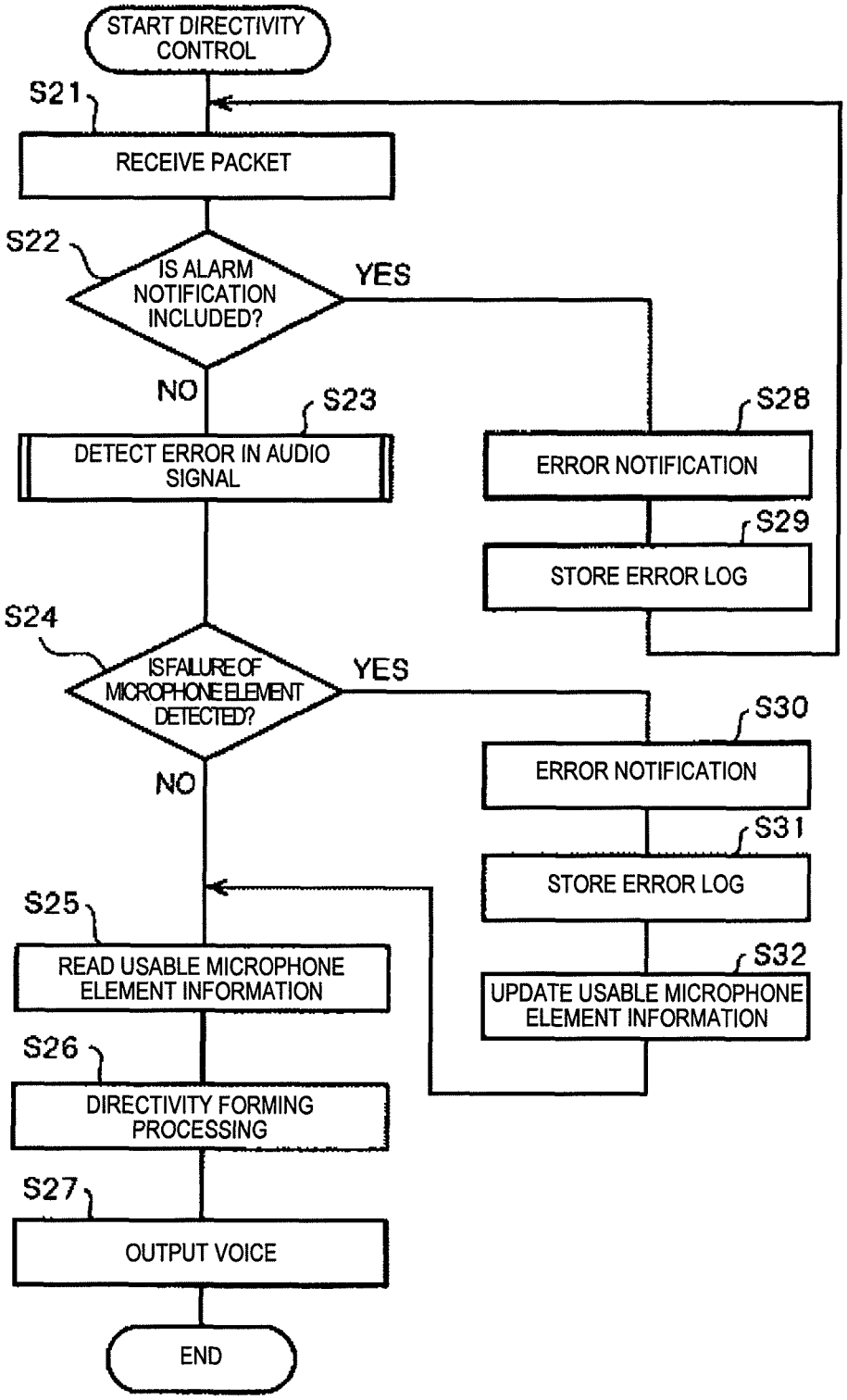
FIG. 8 is a flowchart explaining an operation procedure of a directivity forming operation and an error detection processing in the directivity control device.

Next, an operation of directivity control device 3 will be described. FIG. 8 is a flowchart explaining an operation procedure of the directivity forming operation and the error detection processing in omnidirectional microphone array device 3. In FIG. 8, via communicator 31, signal processor 33 receives packet PKT transmitted from the omnidirectional microphone array device 2 or recorder device 4 (S21). Signal processor 33 determines whether or not the alarm notification is included in packet PKT (S22). In a case where the alarm notification is not included (NO in S22), failure detectors 340, 350, and 360 in signal processor 33 perform the error detection processing of the audio signal (S23). Details of the error detection processing will be described below with reference to FIG. 10 and FIG. 11.

Determination unit 337 in signal processor 33 determines whether or not the failure of the microphone element is detected by failure detectors 340, 350, and 360 (S24). In a case where the failure is not detected (NO in S24), directivity processor 335 in signal processor 33 reads the information on the usable microphone element stored in usable microphone information holder 381 (S25).

Directivity processor 335 forms the directivity of the voice data in the orientation direction calculated by orientation direction calculator 34*a* through an operation of operation unit 32 from omnidirectional microphone array device 2 using the voice data of the normal microphone element, without using the microphone element in failure, that is, without using the voice data of the microphone element in failure among the frequency axis signal of the voice data on which the fast Fourier transform is performed by FFT unit 331 (S26). As described above, by excluding and not using the microphone element in failure, directivity control device 3 can form the directivity of the voice in a specific direction. Therefore, it is possible to suppress the deterioration of the accuracy of forming directivity of a voice in a specific direction.

Inverse FFT unit 336 performs an inverse Fourier transform on the frequency axis signal of the directivity-formed voice data, and outputs the time axis signal of the voice data. In this way, the voice is output from speaker device 37 (S27). Then, the operation of signal processor 33 ends.

On the other hand, in a case where the failure is detected in step S24 (YES in S24), determiner 337 outputs the error notification to display device 36 (S30). An identification number for identifying the microphone element is given to this error notification. In addition, determiner 337 stores (holds) an error log in log information holder 382 in memory 38 (S31). Furthermore, determiner 337 updates the information on the usable microphone element stored in usable microphone information holder 381 (S32). Then, the processing of signal processor 33 proceeds to step S25.

In addition, in step S22, in a case where the alarm notification is included in the packet received from omnidirectional microphone array device 2 (YES in step S22), signal processor 33 outputs the error notification to display device 36 (S28). An identification number for identifying the microphone element is given to this error notification. According to this error notification, as will be described below, an icon of patrol lamp 41 (refer to FIG. 12B) is displayed on the screen of display device 36. In addition, signal processor 33 stores the error log in log information holder 382 in memory 38 (S29). Then, the processing of signal processor 33 returns to step S21.

Figure 9A:
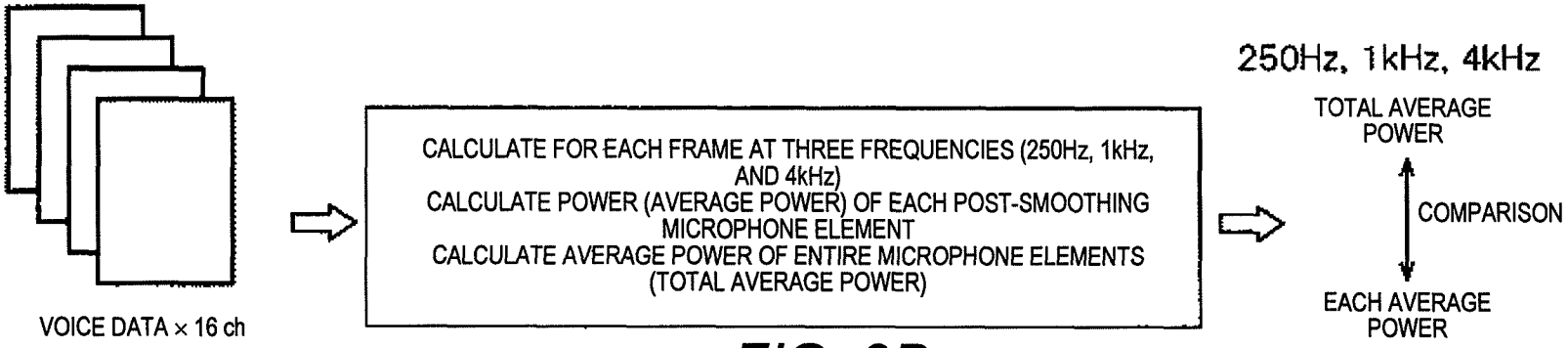
FIG. 9A is a diagram explaining an error detection processing method in the directivity control device.
Figure 9B:
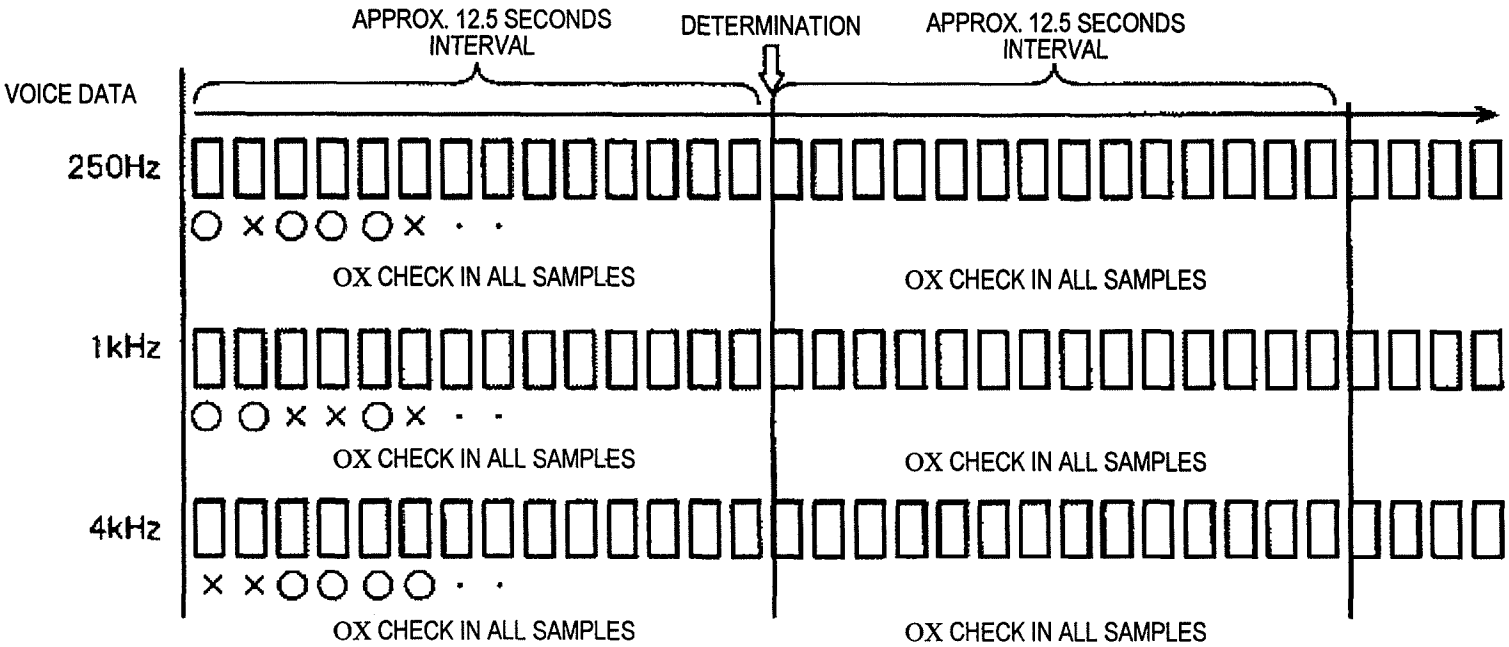
FIG. 9B is a diagram explaining an error detection processing method in a directivity control device.

FIG. 9A and FIG. 9B are diagrams explaining an error detection processing method in directivity control device 3. In the directivity control device 3 side, the processing of determination whether or not there is a failure in the microphone element at three specific frequencies (for example, 250 HZ, 1 kHz, and 4 kHz) is performed. Failure detectors 340, 350, and 360 perform the processing of determining whether or not there is a failure in the microphone element using the voice data of 250 HZ, 1 kHz, and 4 kHz respectively. The operations of the failure determination by failure detectors 340, 350, and 360 are the same except the difference in the frequency which is subject to the determination processing.

As illustrated in FIG. 9A, failure detector 340 calculates the average power of each microphone element using the top 256 pieces of sampling data at the frequency of 250 Hz by the same method as in FIG. 6A. Furthermore, failure detector 340 calculates the total average power in which the average power of each microphone element are averaged. In a case where the difference between the average power and the total average power of each microphone element is within the predetermined range (range of ±6 dB), failure detector 340 determines that the state is normal (indicated as "O" illustrated in FIG. 9B), and in a case where the difference exceeds the predetermined range, failure detector 340 determines that there is an error (indicated as "X" illustrated in FIG. 9B).

Similarly, failure detector 350 calculates the average power and the total average power of each microphone element using the top 256 pieces of sampling data at the frequency of 1 kHz, and similarly compares the difference between the average power and the total average power with the predetermined range (the range of ±6 dB). In addition, similarly, failure detector 360 calculates the average power and the total average power of each microphone element using the top 256 sampling data at the frequency of 4 kHz, and similarly compares the difference between the average power and the total average power with the predetermined range (the range of ±6 dB).

As illustrated in FIG. 9B, failure detector 340 performs the processing of determination whether or not there is a failure within a predetermined interval (as an example, approximately 12.5 seconds). Failure detector 340 compares the difference between the average power and the total average power with the predetermined range (the range of ±6 dB) using the sampling data (250 Hz) of the voice of the microphone element subject to the inspection for the failure detection. In a case where the difference between the average power and the total average power is within the predetermined range (the range of ±6 dB), failure detector 340 determines that the state is normal (indicated as "O" in FIG. 9B), and on the other hand, in a case of exceeding the predetermined range, determines that there is an error (indicated as "X" in FIG. 9B). Failure detector 340 repeats the comparison for each period of approximately 12.5 seconds. In a case where the number of errors shown is proportionally 80% or higher compared to the total number during the period of approximately 12.5 seconds, failure detector 340 determines that there is a failure in the microphone elements. In addition, in the next period of approximately 12.5 seconds, failure detector 340 performs a similar operation on the next microphone element which is subject to the inspection.

In addition, failure detector 350 compares the difference between the average power and the total average power with the predetermined range (the range of ±6 dB) using the sampling data (1 kHz) of the voice of the microphone element subject to the inspection for the failure detection, and then, performs the similar operation. Furthermore, failure detector 360 compares the difference between the average power and the total average power with the predetermined range (the range of ±6 dB) using the sampling data (4 kHz) of the voice of the microphone element subject to the inspection for the failure detection, and then, performs the similar operation.

Figure 10:
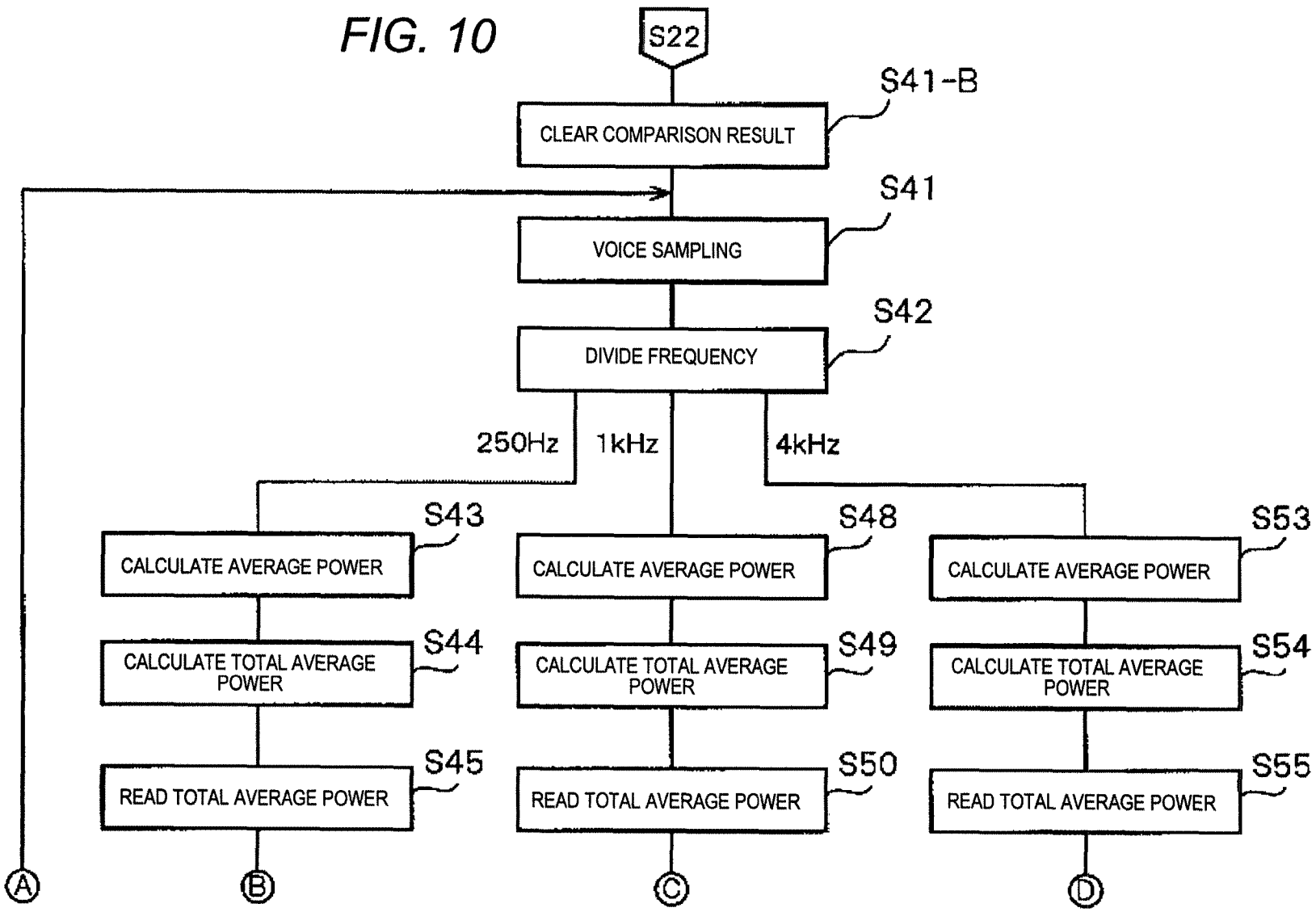
FIG. 10 is a flowchart illustrating an operation procedure of the error detection processing of a voice signal in step S23 illustrated in FIG. 8.
Figure 11:
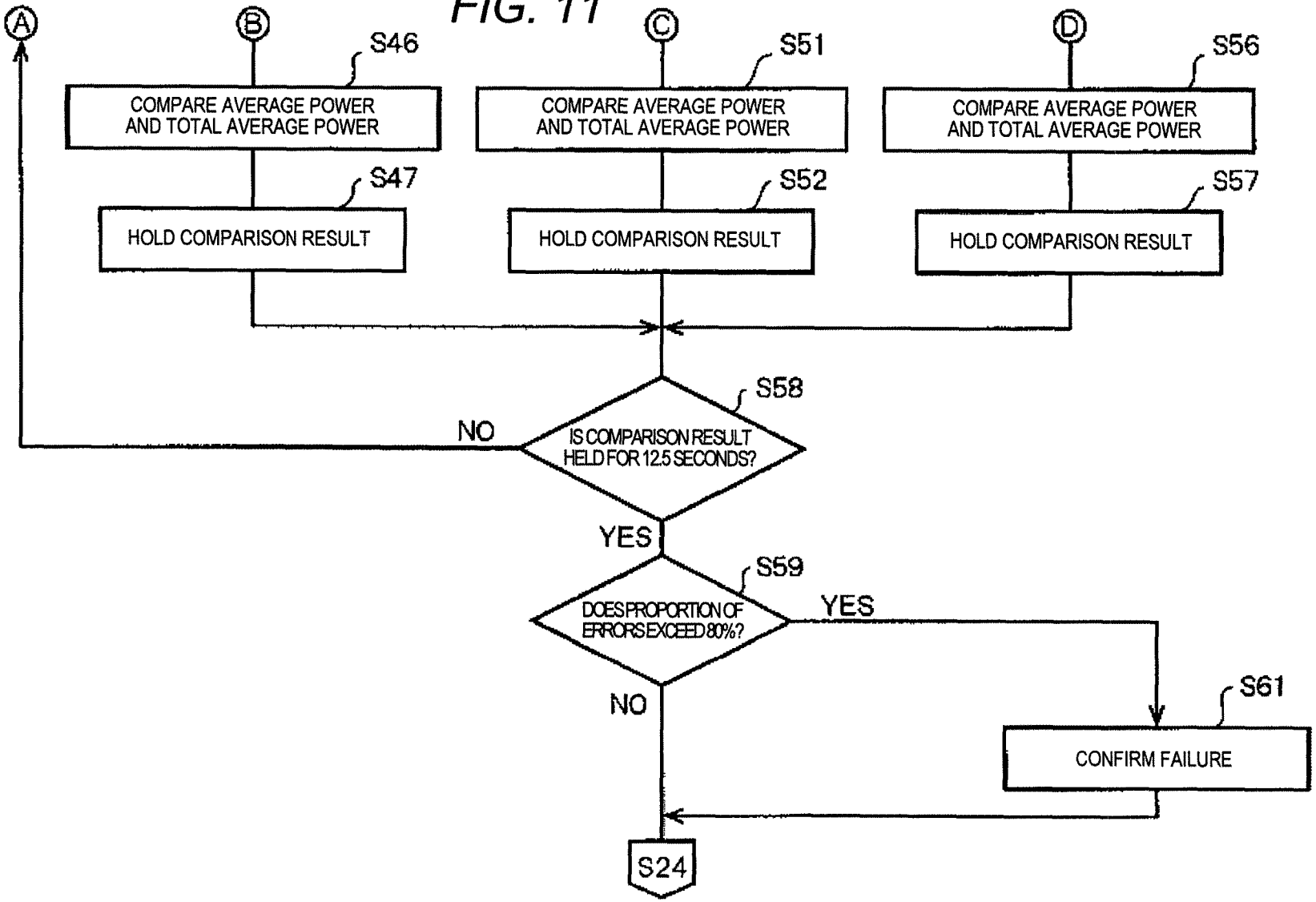
FIG. 11 is a flowchart illustrating the operation procedure of the error detection processing of the voice signal in step S23 subsequent to FIG. 10.

FIG. 10 is a flowchart illustrating an operation procedure of the error detection processing of a voice signal in step S23 illustrated in FIG. 8. FIG. 11 is a flowchart illustrating the operation procedure of the error detection processing of the voice signal in step S23 subsequent to FIG. 10.

In FIG. 10, first, the content in each result holder 345, 355, and 365 is cleared (S41-B). Next, signal processor 33 performs the sampling on the voice data input from omnidirectional microphone array device 2 via communicator 31 (S41). FFT unit 331 performs the fast Fourier transform on the voice data, and divides the frequency axis signal of the voice data into above-described three specific frequencies of 250 Hz, 1 kHz, and 4 kHz (S42). The three frequencies are samples and may be other frequencies regardless of whether or not they are in the audible range.

In a case of voice data of 250 Hz, smoothing unit 341 in failure detector 340 smoothes the power (sound pressure level) of each microphone element, and calculates the average power (S43). Furthermore, average calculation unit 343 calculates the total average power by averaging the power of all the usable (in other words, not in failure) microphone elements including the microphone element which is subject to the inspection (S44).

Comparison unit 342 reads the total average power calculated by average calculation unit 343 (S45), and compares the total average power with the average power of the microphone element subject to the inspection (S46). Comparison unit 342 stores the comparison result in result holder 345 (S47). Then, the processing of signal processor 33 proceeds to step S58.

In addition, in a case of voice data of 1 kHz, smoothing unit 351 in failure detector 350 smoothes the power (sound pressure level) of each microphone element, and calculates the average power (S48). Furthermore, average calculation unit 353 calculates the total average power by averaging the power of all the usable (in other words, not in failure) microphone elements including the microphone element subject to the inspection (S49).

Comparison unit 352 reads the total average power calculated by average calculation unit 343 (S50), and compares the total average power with the average power of the microphone element subject to the inspection (S51). Comparison unit 352 stores the comparison result in result holder 355 (S52). Then, the processing of signal processor 33 proceeds to step S58.

In addition, in a case of voice data of 4 kHz, smoothing unit 361 in failure detector 360 smoothes the power (sound pressure level) of each microphone element, and calculates the average power (S53). Furthermore, average calculator 363 calculates the total average power by averaging the power of all the usable (in other words, not in failure) microphone elements including the microphone element subject to the inspection (S54).

Comparison unit 362 reads the total average power calculated by average calculation unit 363 (S55), and compares the total average power with the average power of the microphone element subject to the inspection (S56). Comparison unit 362 stores the comparison result in result holder 365 (S57). Then, the processing of signal processor 33 proceeds to step S58.

Signal processor 33 determines whether or not the comparison result for a certain period (for example, approximately 12.5 seconds) is stored (held) (S58). In a case where the comparison result for a certain period is not held (NO in S58), the processing of signal processor 33 returns to step S41. On the other hand, in a case where the comparison result for a certain period is held (YES in S58), determiner 337 determines whether or not, as a comparison result for a certain period, the number of comparisons in which the state is determined to be an error exceeds a predetermined proportion (as an example, 80%) (S59).

For example, in a case of exceeding the predetermined proportion (as an example, 80%, hereinafter, the same) (YES in S59), determiner 337 confirms the determination that the microphone element is in failure (S61). Here, determiner 337 confirms the determination that the microphone element is in failure in a case where the number of comparisons in which the state is determined to be an error exceeds the predetermined proportion (80%) in any of the frequency bandwidth 250 Hz, 1 kHz, or 4 kHz. However, determiner 337 may confirm the determination that the microphone element is in failure in a case of exceeding 80% in all of the frequency bandwidths.

On the other hand, in a case where the proportion is equal to or lower than the predetermined proportion (80%) (NO in S59), determiner 337 determines that the microphone element is normal. After step S59 or step S61, the processing of signal processor 33 proceeds to step S24.

Figure 12A:
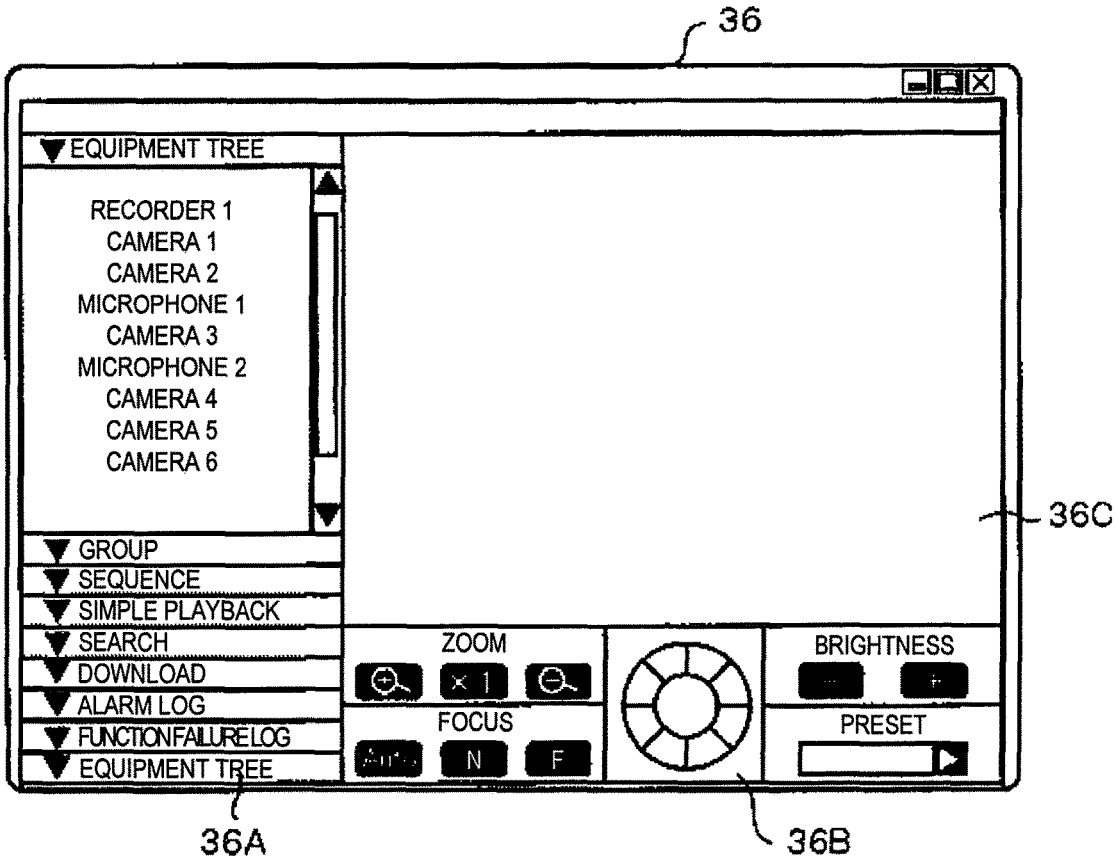
FIG. 12A is a diagram illustrating a screen of a display device.

FIG. 12A is a diagram illustrating a screen of display device 36. Pull-down menu list 36A, various operation buttons 36B, and detailed information presentation section 36C are displayed on the screen of display device 36.

Menus such as equipment tree, group, sequence, simple playback, search, download, alarm log, and equipment failure log are deployed in pull-down menu list 36A in a pull-down format. Operation buttons such as zooming, focus, brightness, and presets are included as various operation buttons 36B. Details of the selected information are displayed on detailed information presentation section 36C.

Figure 12B:
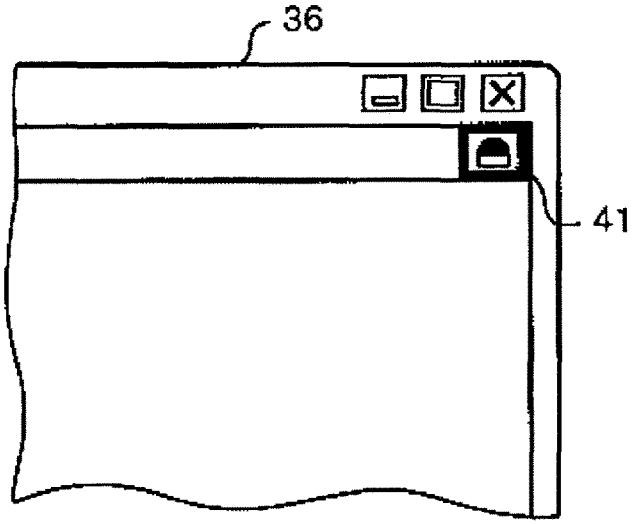
FIG. 12B is a diagram illustrating an icon of a patrol lamp displayed on the screen of the display device.

FIG. 12B is a diagram illustrating of patrol lamp icon 41 displayed on the screen of display device 36. When communicator 31 of directivity control device 3 receives the error notification packet from omnidirectional microphone array device 2 and signal processor 33 performs the error notification in step S28 described above, output controller 34*c* displays patrol lamp icon 41 blinking in red at the right upper corner of the screen on output controller 34*c*. The operator (user, hereinafter, the same) can know that the failure has occurred in the microphone element by seeing the red-blinking patrol lamp icon 41 displayed at the right upper corner.

Thereafter, when communicator 31 of directivity control device 3 receives the error recovery packet from omnidirectional microphone array device 2, output controller 34*c* changes the patrol lamp icon 41 displayed as red-blinking to being displayed as green-blinking on display device 36. When the operator clicks the patrol lamp icon 41, the display of patrol lamp icon 41 disappears.

Figure 13A:
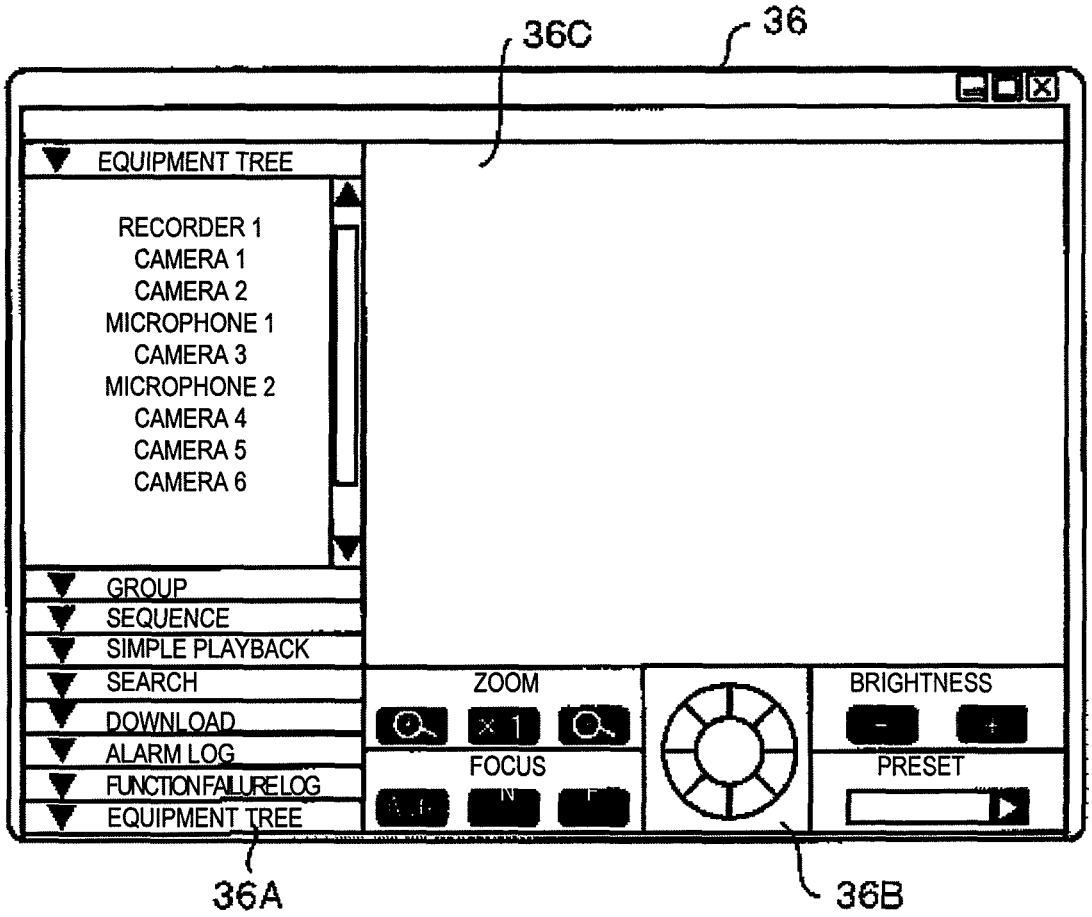
FIG. 13A is a diagram illustrating a screen of a display device.
Figure 13B:
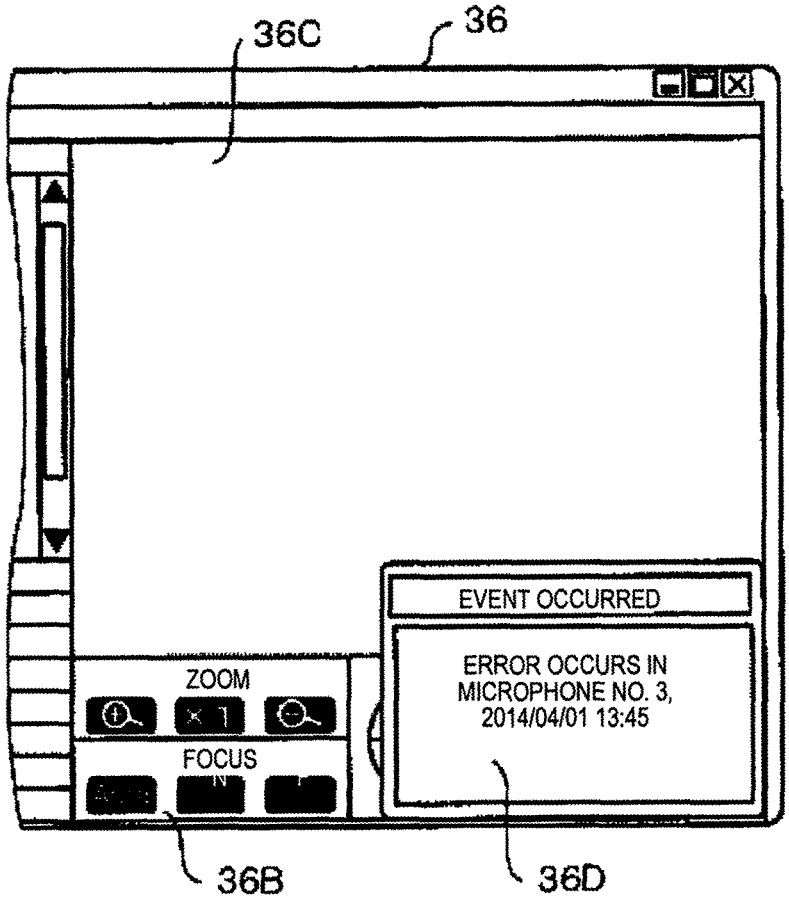
FIG. 13B is a diagram illustrating a pop-up window displayed on the screen of the display device.

FIG. 13A is a diagram illustrating a screen of display device 36. FIG. 13B is a diagram illustrating pop-up window 36D displayed on the screen of display device 36. When directivity control device 3 performs the error detection, and signal processor 33 performs the error notification in step S30 described above, output controller 34*c* displays pop-up window 36D at the right lower corner of the screen of display device 36, which indicates that the event has occurred. In this pop-up window 36D, for example, a message indicating "There is a problem in microphone No. 3. 13:45, 04/01/2014" is displayed. Then, the operator can know that a failure occurred in the microphone element by seeing the pop-up window displayed at the right lower corner of the screen.

Figure 14A:
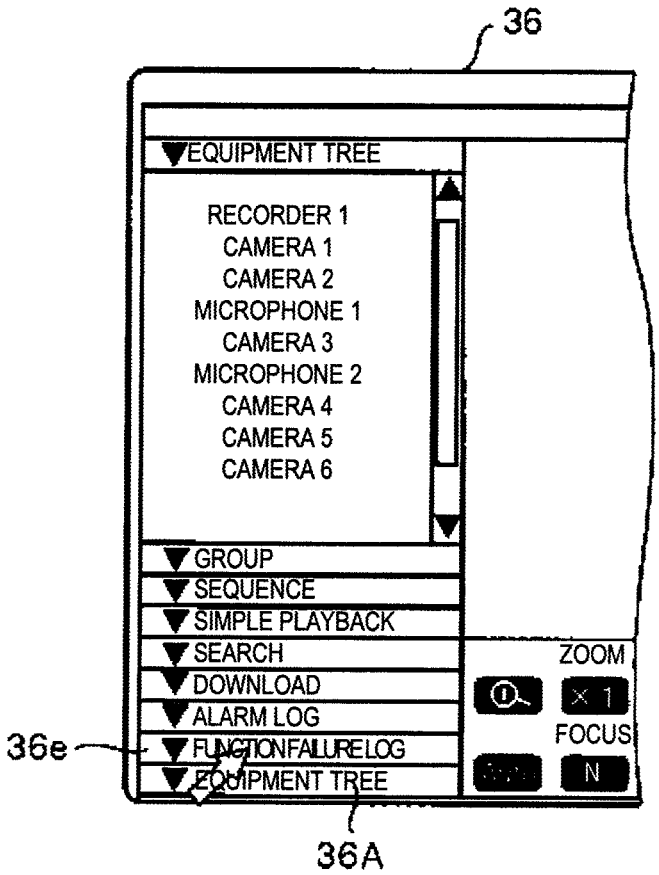
FIG. 14A is a diagram illustrating an operation for the log display to be displayed on the screen of the display device.

In addition, in a case where patrol lamp icon 41 or pop-up window 36D is displayed on the screen of display device 36 or in a case where there is a log stored based on the reception of the error notification packet at the time when the data in recorder device 4 is replayed, the operator can display the log (refer to a function failure log illustrated in FIG. 14A) regarding the failure of the microphone element on the screen of display device 36. FIG. 14A is a diagram illustrating an operation for the log display to be displayed on the screen of display device 36.

When the operator clicks and selects equipment failure log 36*e* included in pull-down menu list 36A, output controller 34*c* deploys and displays equipment failure log 36*e*, and then, equipment failure log list 36*f* is displayed.

Figure 14B:
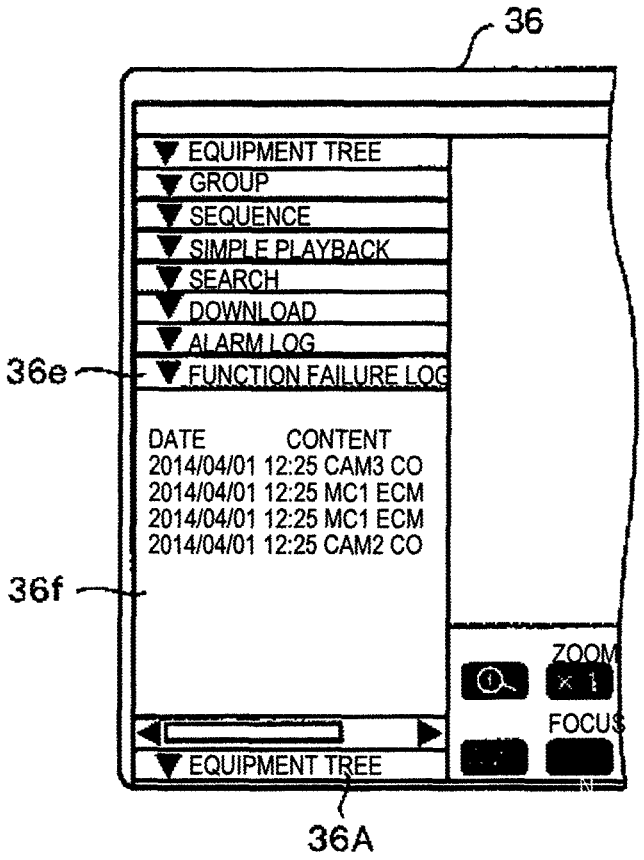
FIG. 14B is a diagram illustrating a part of the screen of the display device, on which the log display is displayed.

FIG. 14B is a diagram illustrating a part of the screen of display device 36, on which the log display is displayed. The date, content, and the name of equipment are displayed as, for example, "12:25/04/01/2014 MIC1 ECM" as the equipment failure log. The operator can know the failure of the microphone element by seeing the log.

The equipment failure log may be displayed on another screen instead of being deployed on pull-down menu list 36A. In addition, as a method of notification to the operator, output controller 34*c* may output an alarm sound from speaker device 37 or may automatically send an electronic mail to an email address registered in advance as well as displaying on display device 36.

As described above, in failure detection system 10 in the present embodiment, omnidirectional microphone array device 2 can simply (for example, by comparing with the average acoustic power of 16 msec for every one second) detect whether or not there is a failure in microphone element 22*i*, and furthermore, transmits the error notification packet that includes the information regarding the microphone element in failure or the error recovery packet that includes the information regarding the microphone element of which the failure is recovered, to directivity control device 3. Directivity control device 3 performs the display according to the error notification packet or the error recovery packet. The operator can simply know the failure of microphone element 22*i* by the patrol lamp blinking or by checking the log.

In addition, directivity control device 3 performs the failure detection at all times from the average power of 250 Hz, 1 kHz, and 4 kHz regardless of the result of the failure detection by omnidirectional microphone array device 2. In this way, directivity control device 3 can detect the failure of the microphone element, which occurs depending on the specific frequency. Therefore, directivity control device 3 can monitor the change of frequency characteristics of the microphone element by monitoring the failure at the specific frequency, and thus, it is possible to detect the failure with high accuracy.

In addition, for example, in a case where the error (problem) is equal to higher than 80% in any frequency bandwidth during 12.5 seconds, directivity control device 3 determines that microphone element 22*i* is in failure. By determining that the microphone element is in failure in a case where the frequency of error occurrence is high, the accuracy of failure determination can be improved. In addition, the proportion may be set to be changeable to other than 80%, and thus, the failure determination can be performed according the situation. Here, the recovery determination is not performed. The operator can know the failure of microphone element 22*i* by the pop-up window being displayed or by checking the log.

In this way, directivity control device 3 monitors the characteristics of each microphone element mounted on omnidirectional microphone array device 2, and even when the problem occurs in the microphone element, it is possible to suppress the deterioration of the directivity characteristics of the microphone element formed in the predetermined direction.

The failure detection of the microphone element may be simply performed in omnidirectional microphone array device 2, and then, directivity control device 3 may perform the failure detection of the microphone element with high accuracy only in a case where the failure is detected, or by performing the cooperative failure detection, it is possible to realize an efficient failure detection system.

Second Embodiment

In the first embodiment, omnidirectional microphone array device 2 transmits the error notification packet or the error recovery packet in addition to the voice data packet. In the second embodiment, an example will be described, in which omnidirectional microphone array device 2G transmits packet PKT of the voice data (voice data packet) while adding microphone failure data on header HD of packet PKT. In addition, in the second embodiment, in contrast to the first embodiment, directivity control device 3 does not perform the processing of detecting the failure of each individual microphone element.

In addition, the configuration of the failure detection system in the second embodiment is the same as that in the first embodiment. Therefore, since the same reference signs are given to the same configuration elements as those in the first embodiment, the description thereof will not be repeated.

Figure 15A:
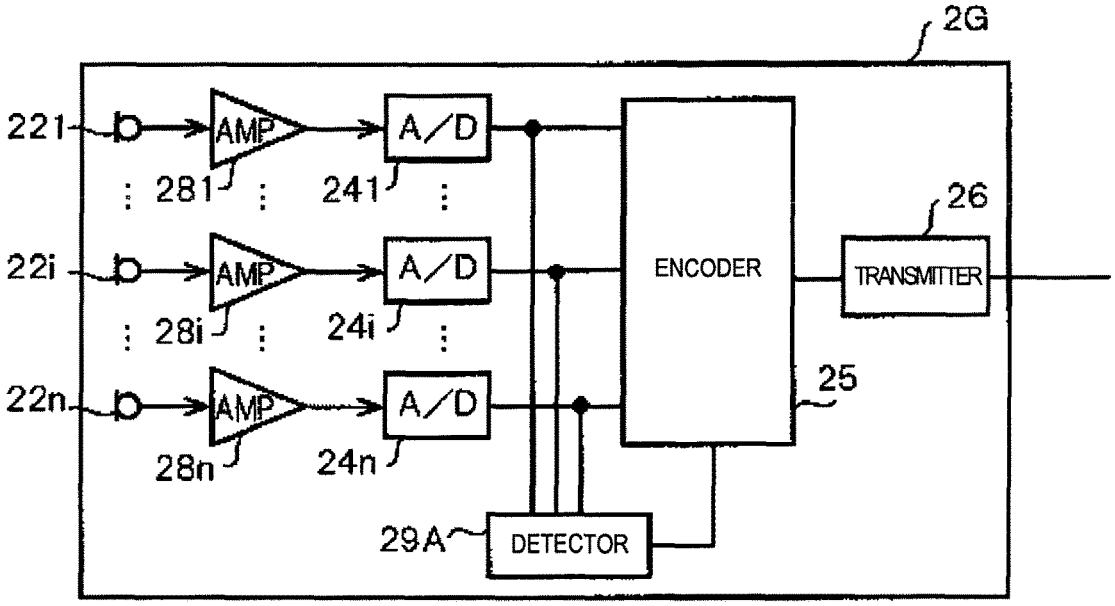
FIG. 15A is a block diagram illustrating an internal configuration of an omnidirectional microphone array device in a second embodiment.

FIG. 15A is a block diagram illustrating an internal configuration of omnidirectional microphone array device 2G in the second embodiment. Omnidirectional microphone array device 2G has a same configuration compared to the omnidirectional microphone array device 2 in the first embodiment except the points that error packet generator 27 is omitted and the output destination of detector 29A is different. When the microphone element is determined to be in failure, detector 29A outputs a notification of the information regarding the microphone element in failure to encoder 25.

Figure 15B:
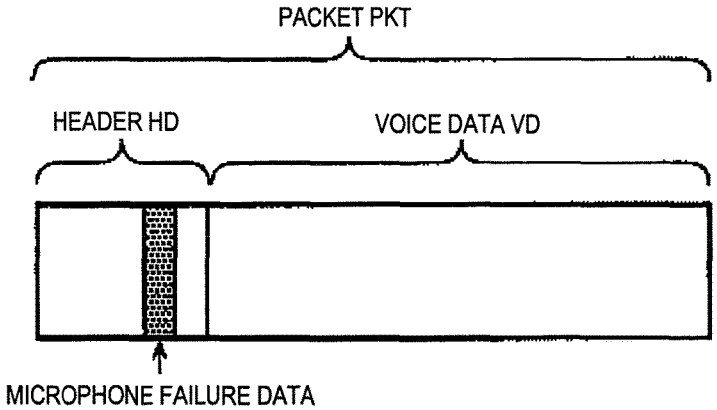
FIG. 15B is a diagram illustrating a structure of a voice packet PKT transmitted from the omnidirectional microphone array device.

When receiving the notification of the information regarding the microphone element in failure, encoder 25 stores the information regarding the microphone element in failure in header HD of packet PKT of the voice data as microphone failure data. FIG. 15B is a diagram illustrating a structure of voice packet PKT transmitted from omnidirectional microphone array device 2G. Transmission unit 26 transmits packet PKT including voice data VD to directivity control device 3 or recorder device 4.

Figure 16:
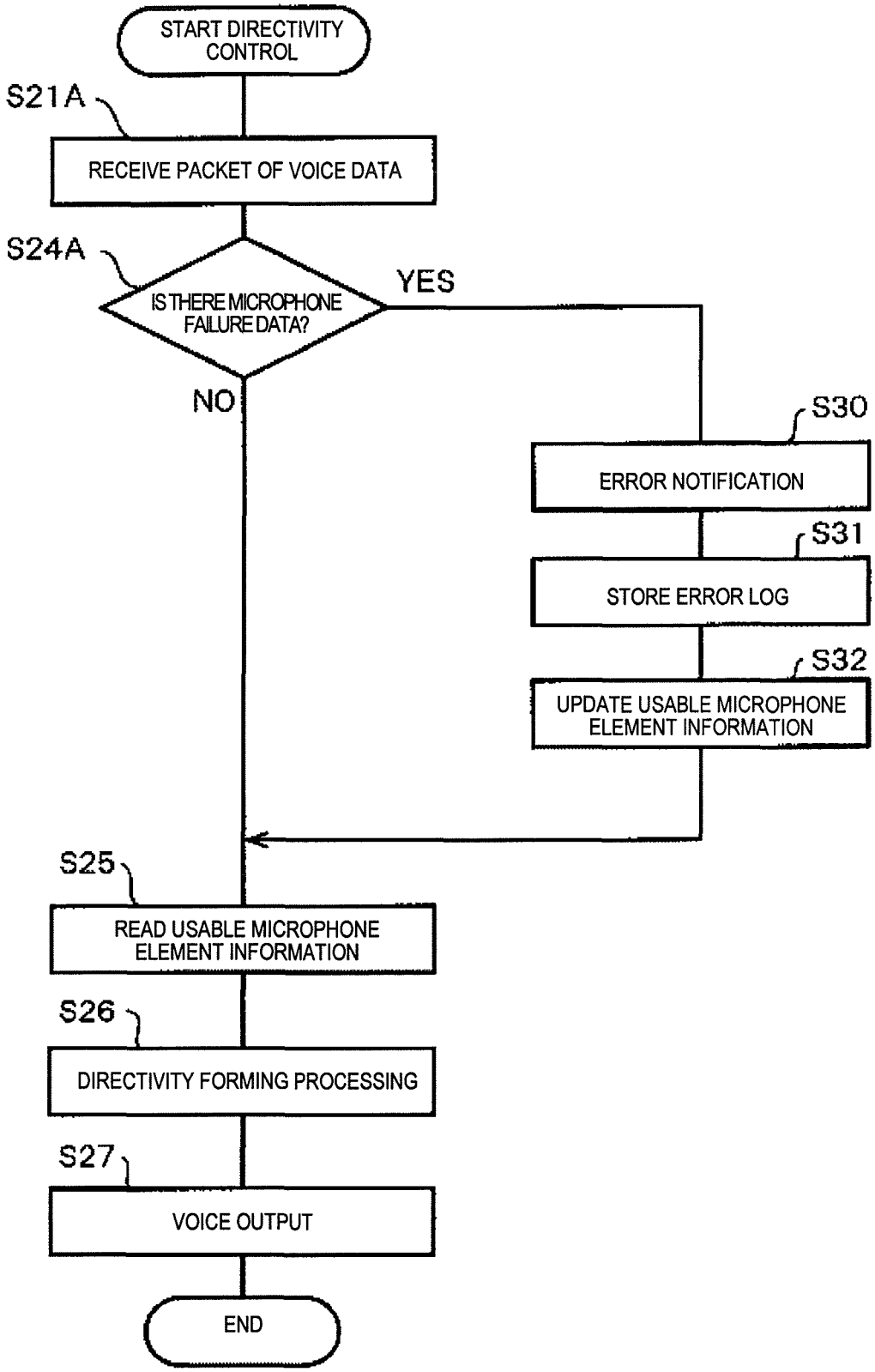
FIG. 16 is a flowchart illustrating an operation procedure of a directivity forming operation and an error detection processing in a directivity control device.

FIG. 16 is a flowchart illustrating an operation procedure of a directivity forming operation and an error detection processing performed by directivity control device 3. In the description in FIG. 16, the same step numbers will be given to the same processing steps as the first embodiment in FIG. 8, and the description thereof will not be repeated. Directivity control device 3 has a configuration same as that in the first embodiment, but as described above, performing the error detection processing of the audio signal in the second embodiment is omitted.

In FIG. 16, signal processor 33 of directivity control device 3 acquires the packet of the voice data from omnidirectional microphone array device 2G or recorder device 4 via communicator 31 (S21A). Determination unit 337 in signal processor 33 determines whether or not there is microphone failure data in the packet of the voice data (S24A). In a case where there is the microphone failure data (YES in step S24A), the processing of determiner 337 proceeds to step S30, and then, the processing tasks same as those in the first embodiment illustrated in FIG. 8 are performed in step S30, S31, and S32. On the other hand, in a case where there is no microphone failure data in step S24A (NO in step S24A), the processing of determiner 337 proceeds to step S25, and then, the processing tasks same as those in the first embodiment are performed in step S25, S26, and S27.

In this way, in failure detection system 10 in the present embodiment, only omnidirectional microphone array device 2G performs the failure determination of the microphone element. Therefore, it is possible to simply perform the processing of determination whether or not there is a failure in the microphone element.

In addition, in failure detection system 10, the information regarding the microphone element in failure (failure data) is added to packet PKT of voice data VD. Therefore, at the time when the recorded voice data is replayed by the input operation to operation unit 32 by the operator, it is possible to omit the detailed analysis processing for the error notification log of packet PKT of voice data VD transmitted from omnidirectional microphone array device 2G or recorder device 4. Thus, it is possible to simply specify the microphone in failure. In addition, in failure detection system 10, even if the playback of the voice data recorded in recorder device 4 may be instructed from any point in time by the operation of the user, it is possible to check whether or not there is a microphone element in failure without performing the analysis of the log stored in recorder device 4. Therefore, it is possible to form the directivity using the usable sound collection element.

Third Embodiment

In the first embodiment, omnidirectional microphone array device 2 performs the failure detection of microphone element 22*i*. In the third embodiment, an example will be described, in which the omnidirectional microphone array device 2 only transmits the packet of the voice data and does not perform the processing of detecting the failure of the microphone element, and directivity control device 3 performs the processing of detecting the failure of the microphone element.

The failure detection system in the third embodiment has almost the same configuration as in first embodiment. Therefore, the same reference signs will be given to the configuration elements same as those in the first embodiment, and the descriptions thereof will not be repeated.

Figure 17:
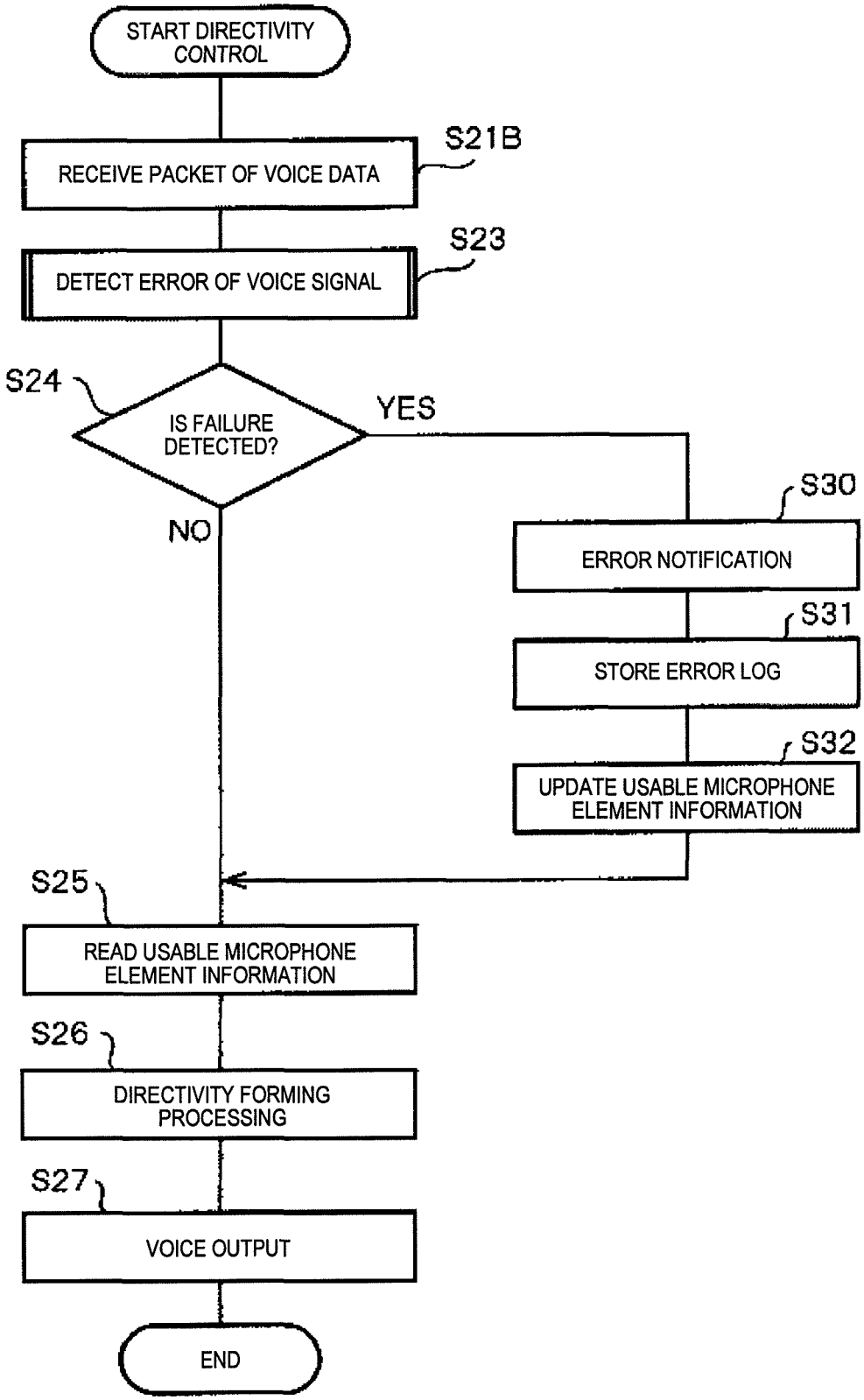
FIG. 17 is a flowchart illustrating an operation procedure of a directivity forming operation and an error detection processing in a directivity control device in a third embodiment.

FIG. 17 is a flowchart illustrating an operation procedure of a directivity forming operation and an error detection processing performed by directivity control device 3 in the third embodiment. In description of FIG. 17, the same step numbers will be given to the processing tasks same as those in the first embodiment (refer to FIG. 8) and the second embodiment (refer to FIG. 16), and the description thereof will not be repeated.

In FIG. 17, signal processor 33 of directivity control device 3 acquires the packet of the voice data from omnidirectional microphone array device 2G (S21B). Failure detectors 340, 350, and 360 in signal processor 33 perform the error detection processing of the audio signal (S23). Since this error detection processing is the same as that illustrated in FIG. 10 and FIG. 11, the description thereof will not be repeated.

In step S24, determiner 337 in signal processor 33 determines whether or not the failure of the microphone element is detected by the failure detectors 340, 350, and 360. Then, the processing tasks in steps S25 to S27 and the processing tasks in steps S30 to S32 have the same content as that of the processing tasks having the same step numbers illustrated in FIG. 8, and the descriptions thereof will not be repeated.

As described above, in failure detection system 10 in the present embodiment, since omnidirectional microphone array device 2 does not perform the processing of detecting the failure of microphone element 22*i*. Therefore, the configuration of omnidirectional microphone array device 2 can be simplified compared to omnidirectional microphone array device 2 in the first embodiment, and furthermore, it is possible to reduce the processing load of omnidirectional microphone array device 2.

As above, various embodiments are described with reference to the drawings. However, it is needless to say that the present disclosure is not limited to the exemplified embodiments. It is apparent that those skilled in the art can conceive various changes or modification examples within the scope of the Claims attached hereto, and it is understood that such changes and modification examples also belong to the technical scope of the present disclosure.

What is claimed is:

1. A failure detection system comprising:

a sound collector including a plurality of sound collection elements;

a first calculator configured to calculate, for each sound collection element of the plurality of sound collection elements, a power value of sound output from the sound collection element;

a second calculator configured to calculate a total average power value, by calculating a sum of at least one power value of sound output from at least one usable sound collection element of the plurality of sound collection elements, without using a power value of sound output from a sound collection element which has already been known as in failure, and by dividing the sum by a number of the at least one usable sound collection element; and a failure detector configured to determine whether or not a sound collection element in failure is present, by comparing a difference between the power value for each sound collection element and the total average power value with a predetermined range.

2. The failure detection system according to claim 1, further comprising:

a directivity former configured to form a directivity of sound in a specific direction using sound collected by the at least one usable sound collection element, except the sound collection element that is determined to be in failure by the failure detector, and a delay time of the sound propagated from the sound source to each of the at least one usable sound collection element.

3. The failure detection system according to claim 1, wherein, when the difference exceeds the predetermined range multiple consecutive times, the failure detector determines that the sound collection element which is used in comparison with the predetermined range is in failure.

4. The failure detection system according to claim 1, wherein, when the difference consecutively exceeds the predetermined range in multiple times in at least one specific frequency, the failure detector determines that the sound collection element which is used in the comparison with the predetermined range is in failure.

5. The failure detection system according to claim 1, wherein, when a proportion in which the difference exceeds the predetermined range is equal to or greater than a predetermined threshold value in a predetermined period, the failure detector determines that the sound collection element which is used in the comparison with the predetermined threshold value is in failure.

6. The failure detection system according to claim 1, further comprising:

a recorder configured to record of the sound collected by the sound collector, wherein the first calculator, the second calculator, and the failure detector are included in the sound collector, and wherein, when it is determined that a sound collection element in failure is present, the sound collector transmits failure data regarding the sound collection element in failure to a directivity former or the recorder, by adding the failure data to a sound packet which includes the sound collected by each sound collection element except the sound collection element in failure.

7. The failure detection system according to claim 2, further comprising:

a recorder configured to record of the sound collected by the sound collector, wherein the first calculator, the second calculator, and the failure detector are included in the sound collector, and wherein, when it is determined that a sound collection element in failure is present, the sound collector transmits failure data regarding the sound collection element in failure to the directivity former or the recorder, by adding the failure data to a sound packet which includes the sound collected by each sound collection element except the sound collection element in failure.

8. The failure detection system according to claim 2, further comprising:

a recorder configured to record of the sound collected by the sound collector, wherein the first calculator, the second calculator, and the failure detector are included in the sound collector, and wherein, when it is determined that a sound collection element in failure is present, the sound collector transmits a failure data packet regarding the sound collection element in failure to the directivity former or the recorder separately from a sound packet which includes the sound collected by each sound collection element except the sound collection element in failure.

9. The failure detection system according to claim 1, further comprising:

a notifier configured to inform that the sound collection element in failure is present.

10. The failure detection system according to claim 9, wherein the notifier notifies a user that the sound collection element in failure is present, by displaying a predetermined icon on a screen of a display.

11. The failure detection system according to claim 9, wherein the notifier notifies a user that the sound collection element in failure is present, by displaying a pop-up window, in which information of the sound collection element in failure is included, on a screen of a display.

12. The failure detection system according to claim 9, wherein the notifier notifies that the sound collection element in failure is present, by displaying failure log information regarding the sound collection element in failure on a screen of a display.

13. The failure detection system according to claim 1, further comprising:

a recorder configured to record the sound collected by the sound collector, the recorder having at least one of a display or a light, wherein the recorder displays, on the display, the information regarding the sound collection element in failure or after the recovery, or turns on the light to indicate the information regarding the sound collection element in failure or after recovery.

14. A failure detection method in a failure detection system that includes a sound collector having a plurality of sound collection elements, the method comprising:

calculating, for each sound collection element of the plurality of sound collection elements, a power value of sound output from the sound collection element;

calculating a total average power value, by calculating a sum of at least one power value of sound output from at least one usable sound collection element of the plurality of collection elements, without using a power value of sound output from a sound collection element which has already been known as in failure, and by dividing the sum by a number of the at least one usable sound collection element; and determining whether or not a sound collection element in failure is present, by comparing a difference between the power value for each sound collection element and the total average power value with a predetermined range.

15. The failure detection system according to claim 1, further comprising:

a memory that stores information regarding the at least one usable sound collection element and an unusable sound collection element;

a receiver that receives a packet;

a processor that determines whether or not the received packet includes an alarm signal, wherein, when the packet does not include the alarm signal, the processor reads, from the memory, the at least one usable sound collection element, the processor forms a directivity of sound in a specific direction using sound collected by the usable sound collection element read from the memory, without using sound collected by the unusable sound collection element, when the packet includes the alarm signal, the processor displays, on a display, an error notification, based on the alarm signal, the processor updates the at least one usable sound collection element and the unusable sound collection element stored in the memory, based on the alarm signal, the processor reads, from the memory, the updated at least one usable sound collection element, the processor forms a directivity of sound in a specific direction using sound collected by the updated at least one usable sound collection element read from the memory, without using sound collected by the updated unusable sound collection element.

* * * * *